US009038210B2

(12) United States Patent
Peet

(10) Patent No.: US 9,038,210 B2
(45) Date of Patent: May 26, 2015

(54) PORTABLE SHOWER APPARATUS

(71) Applicant: James Shannon Peet, Enumclaw, WA (US)

(72) Inventor: James Shannon Peet, Enumclaw, WA (US)

( * ) Notice: Subject to any disclaimer, the term of this patent is extended or adjusted under 35 U.S.C. 154(b) by 330 days.

(21) Appl. No.: 13/842,408

(22) Filed: Mar. 15, 2013

(65) Prior Publication Data

US 2014/0259373 A1 Sep. 18, 2014

(51) Int. Cl.

| | |
|---|---|
| ***A47K 3/28*** | (2006.01) |
| ***B05B 1/18*** | (2006.01) |
| *B05B 15/00* | (2006.01) |

(52) U.S. Cl.

CPC ..... *B05B 1/18* (2013.01); *B05B 15/005* (2013.01); *A47K 3/285* (2013.01)

(58) Field of Classification Search

CPC ..... B05B 1/185; A47K 3/285
USPC ..... 4/602
See application file for complete search history.

(56) References Cited

U.S. PATENT DOCUMENTS

| | | | |
|---|---|---|---|
| 204,879 | A | 6/1878 | Bozerian |
| 542,688 | A | 7/1895 | Shackleford |
| 689,164 | A | 12/1901 | Castle |
| 1,372,598 | A | 3/1921 | Buka |
| 1,386,176 | A | 8/1921 | Holmes |
| 1,479,367 | A | 1/1924 | Campbell |
| 1,663,735 | A | 3/1928 | Talbot et al. |
| 1,844,038 | A | 2/1932 | Hooker |
| 2,033,023 | A | 3/1936 | Brown |
| 2,071,101 | A | 2/1937 | Anderson |
| 2,148,926 | A | 2/1939 | Bullington |
| 2,308,452 | A | 1/1943 | Ortyl |
| 2,457,190 | A | 12/1948 | Warner |
| 2,544,092 | A | 3/1951 | Karlson |
| 2,567,506 | A | 9/1951 | Bowman |
| D171,575 | S | 3/1954 | Bergh, Jr. |
| 2,852,784 | A | 9/1958 | Winkler |
| 3,067,434 | A | 11/1960 | Neal et al. |
| 3,080,568 | A | 3/1963 | Burnett |
| 3,293,664 | A | 12/1966 | Coons |
| 3,332,091 | A | 7/1967 | Greer |
| 3,391,409 | A | 7/1968 | Gatley |
| 3,431,565 | A | 3/1969 | Nelson |
| 3,483,571 | A | 12/1969 | Cox |
| D220,104 | S | 3/1971 | Quackenbush |
| 3,606,618 | A | 9/1971 | Veech |
| 3,629,875 | A | 12/1971 | Dow |
| 3,646,618 | A | 3/1972 | Johnson |
| 3,657,746 | A | 4/1972 | Downey |
| 3,675,251 | A | 7/1972 | Ruscher, Jr. |

(Continued)

*Primary Examiner* — Janie Christiansen

(57) ABSTRACT

A portable shower apparatus includes a shower head, funnel adapter, mounted on an air evacuator tube, for use with a conventional fluid container. The shower head includes a shower face plate having a plurality of fluid dispensing holes; shower face plate is circumvented by a ring connector having internal threads. The funnel adapter includes two opposing openings having cylindrical connector pieces, a first cylindrical connector piece and a second cylindrical connector piece; first connector piece having a greater diameter than the second connector pieces. The shower head ring connector is threadably coupled to the first connector piece while a preexisting filled fluid container is coupled to the second connector piece. When the portable shower is inverted, fluid, preferably water, flows from the fluid container towards the user. Other embodiments are disclosed including a variety of transitional adapters to use with a variety of sizes of conventional fluid containers.

11 Claims, 25 Drawing Sheets

(56) References Cited

U.S. PATENT DOCUMENTS

| | | | | |
|---|---|---|---|---|
| 3,760,431 | A | 9/1973 | Schwibner | |
| 4,193,518 | A | 3/1980 | Holmes | |
| 4,413,363 | A | 11/1983 | Troiano | |
| 4,453,280 | A | 6/1984 | Greenleaf | |
| 4,520,793 | A | 6/1985 | Hall | |
| 4,539,720 | A | 9/1985 | Westerweller | |
| 4,552,125 | A | 11/1985 | Borodulin et al. | |
| 4,975,992 | A | 12/1990 | Patterson et al. | |
| 5,111,538 | A | 5/1992 | Chapman | |
| 5,161,266 | A | 11/1992 | Hildebrand | |
| D337,815 | S | 7/1993 | Yoshida | |
| 5,227,209 | A | 7/1993 | Garland | |
| 5,421,042 | A | 6/1995 | Hibschman | |
| 5,544,369 | A | 8/1996 | Roberts | |
| 5,564,138 | A | 10/1996 | Simpson | |
| 5,660,164 | A | 8/1997 | Rodriguez Sanchez | |
| 5,852,836 | A | 12/1998 | Montrose | |
| 5,911,520 | A | 6/1999 | Kenney | |
| 6,049,919 | A | 4/2000 | Roteman | |
| 6,295,663 | B1 | 10/2001 | Haller et al. | |
| D528,910 | S | 9/2006 | Kingsley | |
| D596,458 | S | 7/2009 | McKinney | |
| D599,616 | S | 9/2009 | Cresswell et al. | |
| D605,942 | S | 12/2009 | Miksovsky | |
| 8,104,112 | B2 | 1/2012 | Tsai et al. | |
| 2001/0037095 | A1 | 11/2001 | Rucinski | |
| 2003/0220620 | A1 | 11/2003 | McMurdo | |
| 2005/0013652 | A1 | 1/2005 | Corbosiero | |
| 2005/0086738 | A1 | 4/2005 | Gragtmans | |
| 2005/0159713 | A1* | 7/2005 | McPherson | 604/279 |
| 2008/0040851 | A1 | 2/2008 | Jackson | |
| 2008/0087624 | A1 | 4/2008 | Buckley | |
| 2008/0256700 | A1 | 10/2008 | Gaiti | |
| 2009/0076468 | A1 | 3/2009 | Hoffoss | |
| 2009/0236341 | A1 | 9/2009 | McKinney et al. | |
| 2010/0199421 | A1* | 8/2010 | Moon et al. | 4/602 |
| 2011/0042286 | A1 | 2/2011 | Schumm, III | |
| 2011/0108575 | A1 | 5/2011 | Alder et al. | |
| 2012/0211528 | A1 | 8/2012 | Greeley | |
| 2012/0267400 | A1 | 10/2012 | Mohr | |
| 2012/0297529 | A1* | 11/2012 | Bowcutt | 4/448 |

* cited by examiner

FIG. 3A
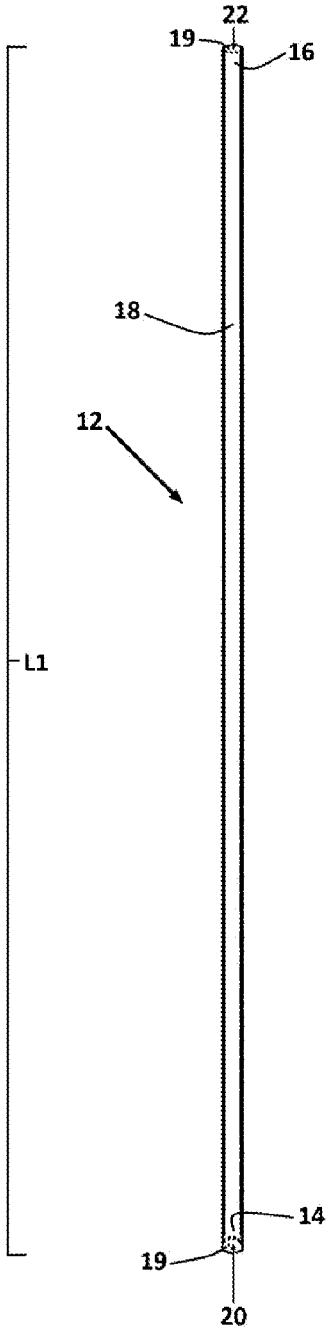
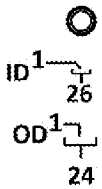
FIG. 3B
FIG. 4A
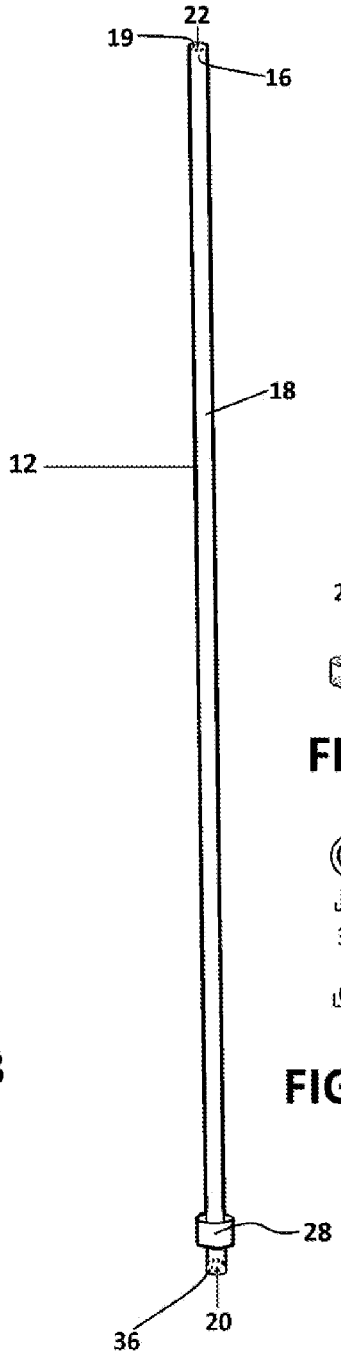
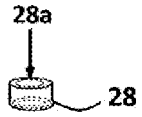
FIG. 4B
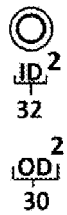
FIG. 4C FIG. 16A
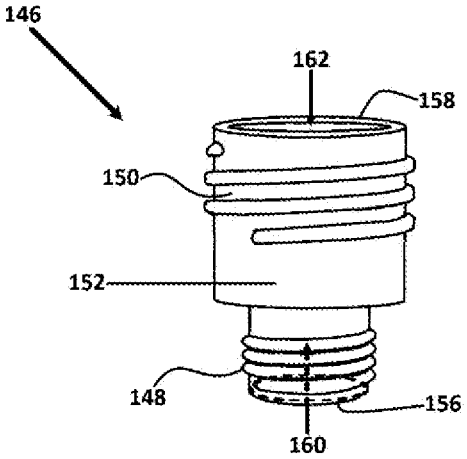
FIG. 16B
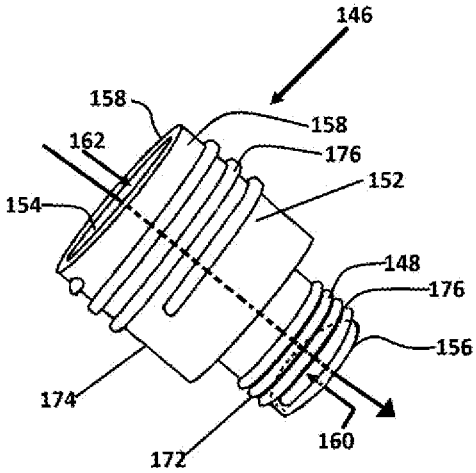
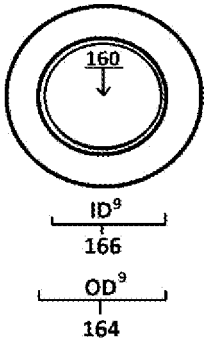
FIG. 16C
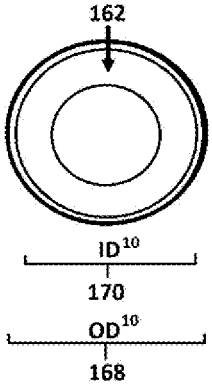
FIG. 16D FIG. 21A
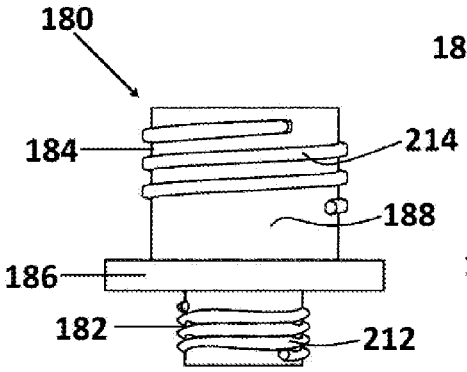
FIG. 21B
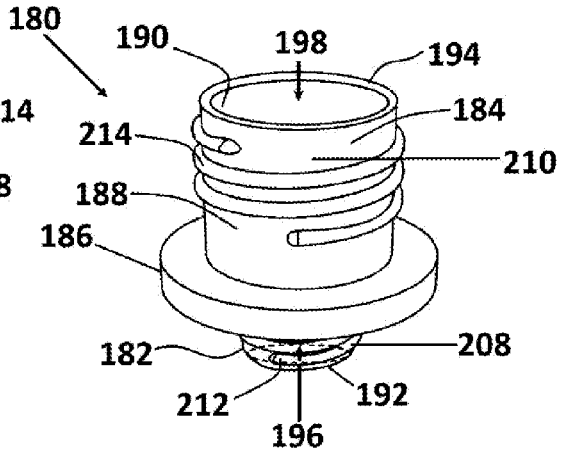
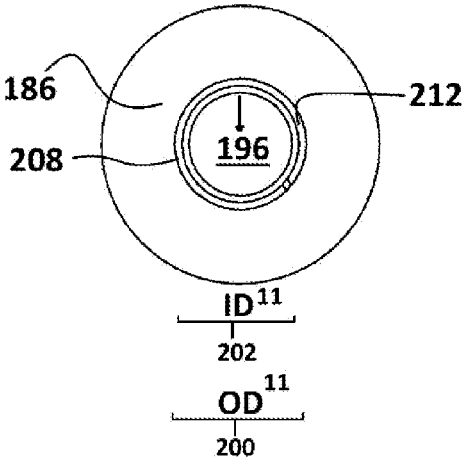
FIG. 21C
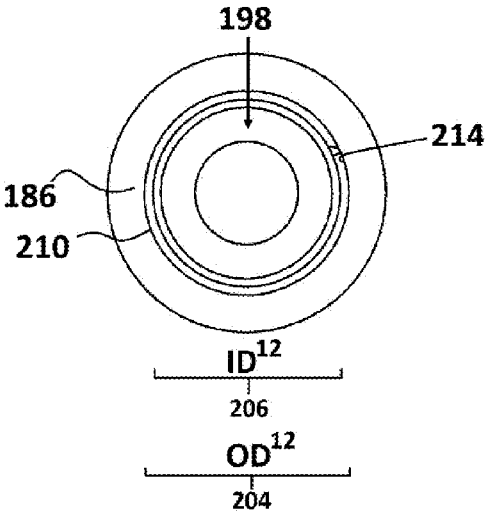
FIG. 21D

PORTABLE SHOWER APPARATUS

BACKGROUND OF THE INVENTION

1. Field of the Invention

The present invention relates generally to a portable shower apparatus, more particularly to hand held gravity impelled portable handheld shower for outdoor use, or indoor use where a conventional shower is not accessible.

2. Prior Art

People have utilized many methods to take showers using portable devices. These devices have included use of cups, bowls, or buckets to douse the user; use of water filled hand held gardening can showers held above the head of the user, either by hand or suspended from a device above the user wherewith a rope is used to angle the gardening can to allow water to flow through the shower head; use of a water filled can hung from devices above the head of the user, wherein the can bottom holes punched therein, or a can includes a top with holes therein, a rope is used to angle the can to allow water to flow. Modern devices include solar showers, inflatable container showers, battery operated showers, and pump operated showers.

The main problem with the above mentioned portable showers is the lack of control over the volume and direction of water flow. While the user can direct where to pour the water, hydraulics dictates that the water will coalesce and form a stream, thereby requiring a larger amount of water than is necessary for a beneficial operation of the portable shower, for example, when washing.

A shower formed by a garden can, and a can with holes therein require including the heavily laden object above the user while using it. In addition, with both instances, a suspending device and rope are generally required. Not all users have these devices available, and the suspension devices reduce the portability of the showering device.

Portable solar showers, U.S. Pat. No. 4,520,793 issued to Hall, and U.S. Pat. No. 6,295,663 issued to Haller et al, describe a large bag that can be filled with fluid, for example, water, with an attached shower head. The bag is usually dark or colored on one side, and transparent on the opposing side, such that the water filled bag is warmed by the sun when suspended or laid flat revealing the transparent side to the solar radiation. Due to the weight of the volume of water, these showers require some mechanical equipment suspended above the user which presents an operational problem such that the user is not physically able to simultaneously hold the solar shower above them while using it.

Portable showers, U.S. Des. Pat. No. 337,815 issued to such as Yoshida, and U.S. Pat. No. 5,111,538 issued to Chapman, are showers that are attached to small electrically operated pumps. The pump draws the water from a free standing vessel and forces it through the showerhead. These pumps require electrical means, such as batteries, and without an electrical source, the shower is non-functional.

Another form of a portable shower is one where a pressure vessel is filled with water and a manual pump or a CO2 device is used to create pressure as described in U.S. Pat. No. 5,911,520 issued to such as Kenney, forcing the water from the container through a hose and out of a showerhead. This method allows the user to set the container on the ground or on a support vessel while directing the flow of water.

Mist sprayer, US Patent Application No. 2012/0267400 filed by Mohr, and US Patent Application No. 2012/0211528 filed by Greeley are designed to fit on bottles, but lack the ability to provide a continuous stream of liquid unless the finger pump is continuously operated.

There are several inventions in the prior art that include a shower head coupled to a bottle. For example, a laundry ironing shower which provides a device to sprinkle water onto clothing, or linens, or other apparel, prior to ironing such that the clothing, or linens, or apparel are damp prior to ironing the articles. This item requires the user to shake the bottle, forcing water out of the shower head. Without shaking, the water will not leave the bottle in a continuous stream as there is no mechanism in place to allow for the replacement of water with air, hence a vacuum is created within the bottle. The volume of water leaving this item is minimal and useful only for dampening clothes prior to using a hot iron on them.

The "Universal Shower Diffuser Saver" (last viewed on Jan. 27, 2013 at: http://www.likecool.com/Universal_Shower-_Diffuser_Saver--Outdoor--Home.html includes a plastic showerhead that screws onto a conventional plastic screw top water or soda bottle. This item requires the user to hold the bottle with attached showerhead above the area being wetted, and to squeeze the bottle, thereby forcing the water out of the shower and onto the user. Without squeezing, the water will not leave the bottle in a continuous stream as there is no mechanism in place to allow for the replacement of water with air, hence a vacuum is created within the bottle. This method also leads to the destruction of the bottle over time through the constant external and internal pressures applied by squeezing it.

Shower Kit for Dromedary® and DromLite™ water storage at http://casanovasadventures.com/catalog/water/p348.htm last viewed on Jan. 27, 2013). This device is designed having tubing to deliver water and having a cap exclusively for water bladders, and is not designed to interfit to conventional water bottles or soda bottles.

HotJugz portable shower is a spray pump with an attached shower nozzle at www.hotjugz.com last viewed on Jan. 27, 2013.

U.S. Pat. No. 5,472,024 issued to Conrad, discloses an adapter for stabilizing a funnel in the opening of a container consists of a body of metal or plastic which contains a central bore internally threaded at each end for accepting the threaded stem of a funnel. The body is externally threaded on one end to engage internally threaded container openings and at the other end contains an internally threaded cavity to engage externally threaded container openings. In this invention, the externally threaded end is not coaxial with the opposing open end, thus no passageway is provided for the flow of fluid or water therethrough.

Various configurations of portable showers including structural elements having shower stalls and tubing have been disclosed in the prior art. For both manufacturers and consumers of such portable showers, their storage and transportation represent a challenging risk. Thus, generally the prior art focuses on a combination of water delivery and a stall component of portable showers, whereby there is an emphasis on creating an environment wherein a person can take a shower in privacy. These arts, while man-portable, are, by nature, large and cumbersome.

The prior art fails to show a portable shower that is transportable, easy and convenient to use and store, and economical to manufacture. In addition the prior art fails to teach a hand held portable shower that removably threadably couples to a fluid container or vessel, wherein water is expelled from the portable shower impelled by gravity and air evacuator tube.

Further, the prior art fails to show a portable shower having a variety of adapters that will allow the portable shower to be attached to a variety of fluid containers having different size openings.

SUMMARY

The present invention provides a portable shower apparatus. In operation, the portable shower is easily coupled to a preexisting fluid container, for example a filled water bottle. The invention may easily be utilized with fluid containers of a variety of sizes, for example, any one of a water bottle, a soda bottle, liter soda bottle, energy drink bottle, gallon milk bottle, gallon ice tea bottle, canteen, etc. The invention may advantageously be utilized as an outdoor washing apparatus in open spaces such as, for example, pools, beaches, gardens, campgrounds, disaster areas, etc. In operation, fluid, preferably water, can be heated by the solar radiation.

The portable shower apparatus embodying features of the invention including an air evacuator tube; a shower head having a shower plate including fluid distribution holes; and a funnel adapter. Shower head comprises a shower plate circumvented by a ring connector collar. The shower plate includes a plurality of fluid distribution holes and a centrally located nipple connector having a through bore. The shower head, funnel adapter, and preexisting fluid container are fluidly connected to each other via adapters. In another exemplary embodiment of the present invention a wide container adapter is disclosed. Still further, another exemplary embodiment of the present invention a narrow container adapter is disclosed.

In operation, the portable shower is easily coupled to a preexisting fluid container, for example a filled plastic water bottle that is particularly suited for handling the assembled portable shower by hand. In other embodiments, the threads of the funnel adapter, the threads of the wide container adapter, and the threads of the narrow container adapter are compatible to a variety of standard container threads and thereby allow the three adaptors to function in a variety of situations using a variety of standard preexisting fluid containers The invention may easily be utilized with fluid containers of a variety of sizes, for example, any one of a water bottle, a soda bottle, liter soda bottle, energy drink bottle, gallon milk bottle, gallon ice tea bottle, canteen, etc.

In accordance, with the various embodiments of the present invention, a portable shower apparatus is disclosed. The present invention provides a portable shower which may advantageously be utilized as an outdoor washing apparatus in open spaces such as, for example, pools, gardens, beach, campgrounds, disaster areas, etc. In operation, the portable shower fluid, preferably water, can be heated by the solar radiation. In one embodiment, the portable shower includes a shower head, a funnel adapter having a first externally threaded connector piece for coupling to a shower head having interior threaded connector piece; and further funnel including a second internally threaded connector piece for coupling to a preexisting water container, for example a 1 liter plastic water bottle, having an externally threaded neck opening, and an air evacuator tube for delivering environmental air into the water container as water is sprayed through a shower plate of the portable shower apparatus. The shower head, funnel adapter, and water container are removably threadably attached to each other. When the portable shower apparatus is not in use, for example, stored or in transported, the shower head, funnel adapter, air evacuator tube may be detached from one another to provide even greater compactness and portability of the shower.

In another embodiment, a second adapter, a wide fluid container adapter, can be used with the portable shower apparatus when using a water container having an opening with a wide diameter and an exterior threaded neck, for example a Nalgene® bottle. The wide fluid container adapter, includes a first connector piece for removably threadably attaching to the second connector piece of the funnel adapter, and further the second adapter includes a second connector piece for removably threadably attaching to the wide fluid container, for example, a Nalgene® bottle.

The unique portable shower apparatus disclosed allows commercially available fluid containers to be adapted for use with the portable shower apparatus to deliver fluid to a user. In a preferred embodiment of the present invention, the portable shower apparatus can be used to provide a shower to the user in an outdoor environment, or disaster area, for example, camping, at the beach, at a pool, or in the alternative, a home environment where standard plumbing conditions are not available. Yet other embodiments, of the present invention may also be used by a user to clean wounds on themselves and others. In addition, the portable shower provides a non-threatening portable shower to wash animals.

The elements of the portable shower are connected to each other via a variety of transition adapters assembled along a centrally positioned air evacuator tube. Further, the preexisting water containers are removably connected to the portable shower via a variety of transition adapters.

The air evacuator tube is made of non-corrosive material, preferably polymeric material, for hot or cold water. The air evacuator tube is flexible linear hollow tube having two opposing open ends. The air evacuator tube may be formed in any suitable manner but preferably is injection mold technique from polymeric materials including any one of acrylonitrile butadiene styrene (ABS), polyvinyl chloride (PVC), or polyethylene (PE), or polybutylene (PB). In a preferred embodiment of the present invention, the air evacuator tube is fabricated from ABS or PE using injection-mold technique. Flexible evacuator tube can be easily bent and, therefore, is generally used where bending during assembly is required. Hard-temper evacuator tube is stiff tubing and should be used when rigidity is desired. In this embodiment, the flexible evacuator tube can be manufactured of soft materials including any one of PVC, vinyl, nylon, silicone, rubber.

Various preferred embodiments of the present invention include a shower head removably attached to a funnel adapter which adapts to a conventional water bottle filled with water into a portable shower. A conventional water bottle can include any one of plastic water bottles, plastic soda bottles, and the like. Preferred embodiments include a shower head including a shower face plate; shower face plate including a variety of fluid distribution holes and a centrally located cylindrical connector nipple; connector nipple including a round bore therein the air evacuator tube is inserted; shower face plate circumventially bound by a ring collar adapter; ring collar adapter having an external wall surface and internal wall surface wherein the internal surface includes female threads. The interior threads are preconfigured to removably attach to the funnel adapter, as described herewith.

The transitory funnel adapter, according to the preferred embodiment of the present invention includes a single body formed by conical portion, a tubular portion, and a cylindrical portion, and a hollow space extended throughin for the passage of fluid. The funnel adapter including a first end and a second end; two opposing openings, a first opening and a second opening; first opening including a diameter greater than the diameter of the second opening. The cylindrical portion includes a cylindrical connector piece having exterior threads compatible with the interior threads of the shower head ring connector collar. The tubular portion includes a tubular connector piece having interior threads compatible with the exterior threads of a conventional fluid container, for example, a plastic water bottle, or plastic soda bottle.

Additional adapters are embodied as part of the present invention for use with a variety of preexisting water containers having different neck diameters and having at least exterior threads or interior threads. For example, a tubular adapter having an exterior threaded neck can be removably coupled to a pre-existing water container, for example, a Kleen Kanteen® bottle.

It is therefore an object of the present invention to provide a new portable shower apparatus which has many advantages and provides novel features that result in a new portable shower apparatus which is not anticipated, rendered obvious, suggested or even implied by any of the prior art portable showers, either alone or in combination thereof.

It is another object of the present invention to provide a new portable shower apparatus which may be easily and efficiently manufactured and marketed.

An even further object of the present invention is to provide a new portable shower apparatus having a funnel adapter for directing fluid from a fluid container.

An even further object of the present invention is to provide a new portable shower apparatus having a funnel adapter, and a wide container adapter, for directing fluid from a compatible fluid container.

An even further object of the present invention is to provide a new portable shower apparatus having a funnel adapter, and a narrow container adapter, for directing fluid from a compatible fluid container.

Still yet another object of the present invention is to provide a new portable shower apparatus having compatibility with a variety of sizes of adapters for directing fluid from a variety of sizes of fluid containers.

Even still another object of the present invention is to provide a portable shower apparatus compatible with a fluid container without damage or remanufacturing to the fluid container, for example a conventional plastic water bottle.

These together with other objects of the present invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings, and brief and detailed descriptions in which there are illustrated preferred and exemplary embodiments of the present invention. All objects, features and advantages of the present invention will become apparent in the following detailed written description.

This invention can be utilized by members of a variety of organization in conditions where they are deployed or located whereby bathing facilities are limited. Such organizations include, but are not limited to, the Department of Defense, the Department of the Interior, the Federal Emergency Management Agency, and the Department of Agriculture. Other organizations, both governmental and non-governmental, may be able to distribute the invention to assist other persons where bathing facilities are limited. Such organizations include, but are not limited to, the US Department of State, the US Agency for Industrial Development, the American Red Cross, the International Red Cross, and various NGOs dedicated to refugee relief and assistance in Developing Countries.

The Summary is neither intended nor should be construed as being representative of the full extent and scope of the present invention, which these and additional aspects will become more readily apparent from the detailed description, particularly when taken together with the appended drawings.

REFERENCE NUMERALS

10—portable shower apparatus
12—air evacuator tube
14—first end of air evacuator tube
16—second end of air evacuator tube
18—exterior surface of air evacuator tube
19—interior surface of air evacuator tube
20—first opening of air evacuator tube, inlet
22—second opening of air evacuator tube, outlet
24—Outer Diameter ($OD^1$) of evacuator tube
26—Inner Diameter ($ID^1$) of evacuator tube
28—evacuator tube stop
30—Outer Diameter ($OD^2$) centering evacuator tube stop
32—Inner Diameter ($ID^2$) centering evacuator tube stop
34—shower head
36—ring connector collar (interior thread)
38—exterior wall ring connector collar
40—interior wall of ring connector collar
42—Outer Diameter ($OD^3$) of ring connector collar
44—Inner Diameter ($ID^3$) of ring connector collar
46—rim of connector collar
**46*a***—base edge of ring connector collar
48—ribbed exterior wall surface of ring connector collar
50—smooth exterior wall of ring connector collar
52—interior threads ring connector collar
54—shower faceplate
56—fluid distribution holes
58—cylindrical connector nipple
60—cylindrical connector nipple bore
62—nipple rim
64—exterior nipple wall
66—interior bore wall
68—Outer diameter ($OD^4$) of nipple bore
70—Inner diameter ($ID^4$) of bore
72—funnel adapter
74—conical portion of funnel adapter
76—cylindrical portion of funnel adapter
78—tubular portion of funnel adapter
80—first end funnel adapter
82—second end funnel adapter
84—first opening of funnel adapter
86—second opening of funnel adapter
88—cylindrical connector piece of funnel adapter
90—tubular connector piece of funnel adapter
92—exterior surface of funnel adapter
94—interior surface of funnel adapter
96—Outer Diameter ($OD^5$) of first opening of funnel adapter
98—Inner Diameter ($ID^5$) of first opening of funnel adapter
100—Outer Diameter ($OD^6$) of second opening of funnel adapter
102—Inner Diameter ($ID^6$) second opening of funnel adapter
104—exterior threads of cylindrical connector piece of funnel adapter
106—interior threads of tubular connector piece of funnel adapter
108—ribbed surface of tubular portion of funnel adapter
110—smooth tubular member of funnel adapter
112—wide mouth fluid container adapter
114—tubular connector portion of wide fluid container adapter
116—cylindrical connector portion of wide fluid container adapter
**116*a***—cylindrical connector portion base plate
118—tubular connector piece of wide fluid container adapter
120—cap connector piece of wide fluid container adapter
122—exterior wall surface of wide fluid container adapter
124—interior wall surface of wide fluid container adapter
126—first end of wide fluid container adapter
128—second end of wide fluid container adapter
130—first opening of wide fluid container adapter

132—second opening of wide fluid container adapter
134—Outer Diameter ($OD^7$) of first opening of wide fluid container adapter
136—Inner Diameter ($ID^7$) of first opening of wide fluid container adapter
138—Outer Diameter ($OD^8$) of second opening of wide fluid water container adapter
140—Inner Diameter ($ID^8$) of second opening of wide fluid water container adapter
142—exterior threads of tubular member of wide fluid container adapter
144—interior threads on cap connector piece of wide water container adapter
146—tubular adapter
148—first tubular connector portion of tubular adapter
150—second tubular connector portion of tubular adapter
152—exterior wall surface of tubular adapter
154—interior wall surface of tubular adapter
156—first end of tubular adapter
158—second end of tubular adapter
160—first opening of tubular adapter
162—second opening of tubular adapter
164—Outer Diameter ($OD^9$) of first opening of tubular adapter
166—Inner Diameter ($ID^9$) of first opening of tubular adapter
168—Outer Diameter ($OD^{10}$) of second opening of tubular adapter
170—Inner Diameter ($ID^{10}$) of second opening of tubular adapter
172—first connector piece of tubular adapter
174—second connector piece of tubular adapter
176—exterior threads on first connector piece of tubular adapter
178—exterior threads on second connector piece of tubular adapter
180—flange tubular adapter
182—first tubular portion of flange adapter
184—second tubular portion of flange adapter
186—flange portion of flange adapter
188—exterior wall surface of flange adapter
190—interior wall surface of flange adapter
192—first end of flange adapter
194—second end of flange adapter
196—first opening of flange adapter
198—second opening of flange adapter
200—Outer Diameter of first opening of flange adapter ($OD^{11}$)
202—Inner Diameter of first opening of flange adapter ($ID^{11}$)
204—Outer Diameter of second opening of flange adapter ($OD^{12}$)
206—Inner Diameter of second opening of flange adapter ($OD^{12}$)
208—first tubular connector piece of flange adapter
210—second tubular connector piece of flange adapter
212—exterior threads on first connector piece of flange adapter
214—exterior threads on second connector piece of flange adapter
216—hybrid funnel adapter
218—conical portion of hybrid funnel adapter
219—tubular portion of hybrid funnel adapter
220—cylindrical portion of hybrid funnel adapter
222—first end of hybrid funnel adapter
224—second end of hybrid funnel adapter
226—rim of conical portion of hybrid funnel adapter
228—rim of tubular portion of hybrid funnel adapter
230—first opening of hybrid funnel adapter
232—second opening of hybrid funnel adapter
234—cylindrical connector piece of hybrid funnel adapter
236—tubular connector piece of hybrid funnel adapter
238—exterior surface of hybrid funnel adapter
240—interior surface of hybrid funnel adapter
242—Outer Diameter ($OD^{13}$) of first opening of hybrid funnel adapter
244—Inner Diameter ($ID^{13}$) of first opening of hybrid funnel adapter
246—Outer Diameter ($OD^{14}$) of second opening of hybrid funnel adapter
248—Inner Diameter ($ID^{14}$) of second opening of hybrid funnel adapter
250—exterior threads of cylindrical connector piece of hybrid funnel adapter
252—exterior threads of tubular connector piece of hybrid funnel adapter
254—snap funnel adapter
256—conical portion of snap funnel adapter
258—tubular portion of snap funnel adapter
260—cylindrical portion of snap funnel adapter
262—first end of snap funnel adapter
264—second end of snap funnel adapter
268—rim of tubular portion of snap funnel adapter
270—ribbed surface of snap funnel adapter
272—first opening of snap funnel adapter
274—second opening of snap funnel adapter
276—cylindrical connector piece of snap funnel adapter
278—tubular connector piece of snap funnel adapter
280—exterior surface of snap funnel adapter
282—interior surface of snap funnel adapter
290—Outer Diameter ($OD^{15}$) of first opening of snap funnel adapter
292—Inner Diameter ($ID^{15}$) of first opening of snap funnel adapter
294—Outer Diameter ($OD^{16}$) of second opening of snap funnel adapter
296—Inner Diameter ($ID^{16}$) of second opening of snap funnel adapter
298—exterior lip of cylindrical connector piece of snap funnel adapter
300—interior threads of tubular connector piece of snap funnel adapter
302—fluid container with exterior threads on narrow tubular neck opening (for example, 1 Liter bottle, ½ gallon milk jug, 1 liter juice jug)
304—tubular neck of fluid container
306—exterior threads on tubular connector piece of fluid container
308—fluid
310—fluid container with exterior threads on wide circumferential neck opening (for example, Nalgene® Bottle)
312—neck on wide fluid container (for example, Nalgene® Bottle)
314—exterior threads on connector piece of wide fluid container (for example, Nalgene® Bottle)
316—fluid container with interior threaded tubular neck opening (for example, Klean Kanteen®)
318—neck with interior threads (for example, Klean Kanteen®)
320—interior threads on tubular connector piece on fluid container (for example Klean Kanteen®)
322—shower head with smooth exterior surface
324—funnel adapter with smooth tubular exterior surface
326—shower head with lip
328—lip
330—shower plate on lip shower head

332—fluid distribution holes on lip shower head
334—cylindrical connector nipple on lip shower head
336—bore
338—connector ring on lip shower head
340—exterior wall of connector ring
342—interior wall of connector ring
344—rim of connector ring
346—Outer Diameter ($OD^{17}$) of lip shower head
348—Inner Diameter ($ID^{17}$) of lip shower head

BRIEF DESCRIPTION

The disclosure will be better understood and objects other than those set forth above will become apparent when consideration is given to the following detailed description thereof. Such description makes reference to the annexed drawings wherein:

FIG. 3A is a perspective view of an air evacuator tube according to one particular embodiment of the invention.

FIG. 3B is a cross sectional view of the air evacuator tube of FIG. 3A according to an embodiment of the invention.

FIG. 4A is a perspective view of an air evacuator tube, also showing a stop thereon the first end of the air evacuator tube according to an embodiment of the invention.

FIG. 4B is a perspective view of the stop.

FIG. 4C is a cross sectional view of the stop.

FIG. 16A is a perspective side view of a tubular adapter according to an embodiment of the present invention.

FIG. 16B is a side perspective view of the tubular adapter.

FIG. 16C is a cross sectional view of one end of the tubular adapter.

FIG. 16D is a cross sectional view of a second end the tubular adapter.

FIG. 21A is a side planar view of a flange tubular adapter according to an embodiment of the invention.

FIG. 21B is a perspective view of the flange tubular adapter.

FIG. 21C is cross section view of a first end of the flange tubular adapter.

FIG. 21D is a cross sectional view of a second end of the flange tubular adapter.

DETAILED DESCRIPTION

Figure 1:
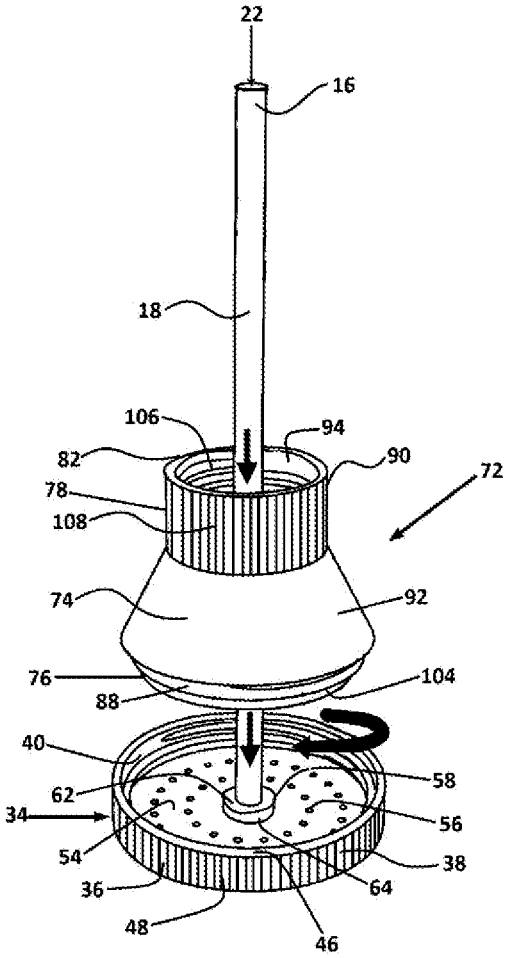
FIG. 1 is a top perspective view of a portable shower according to one particular embodiment of the invention.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modification, equivalents, and alternative falling within the spirit and scope of the disclosure.

Figure 2:
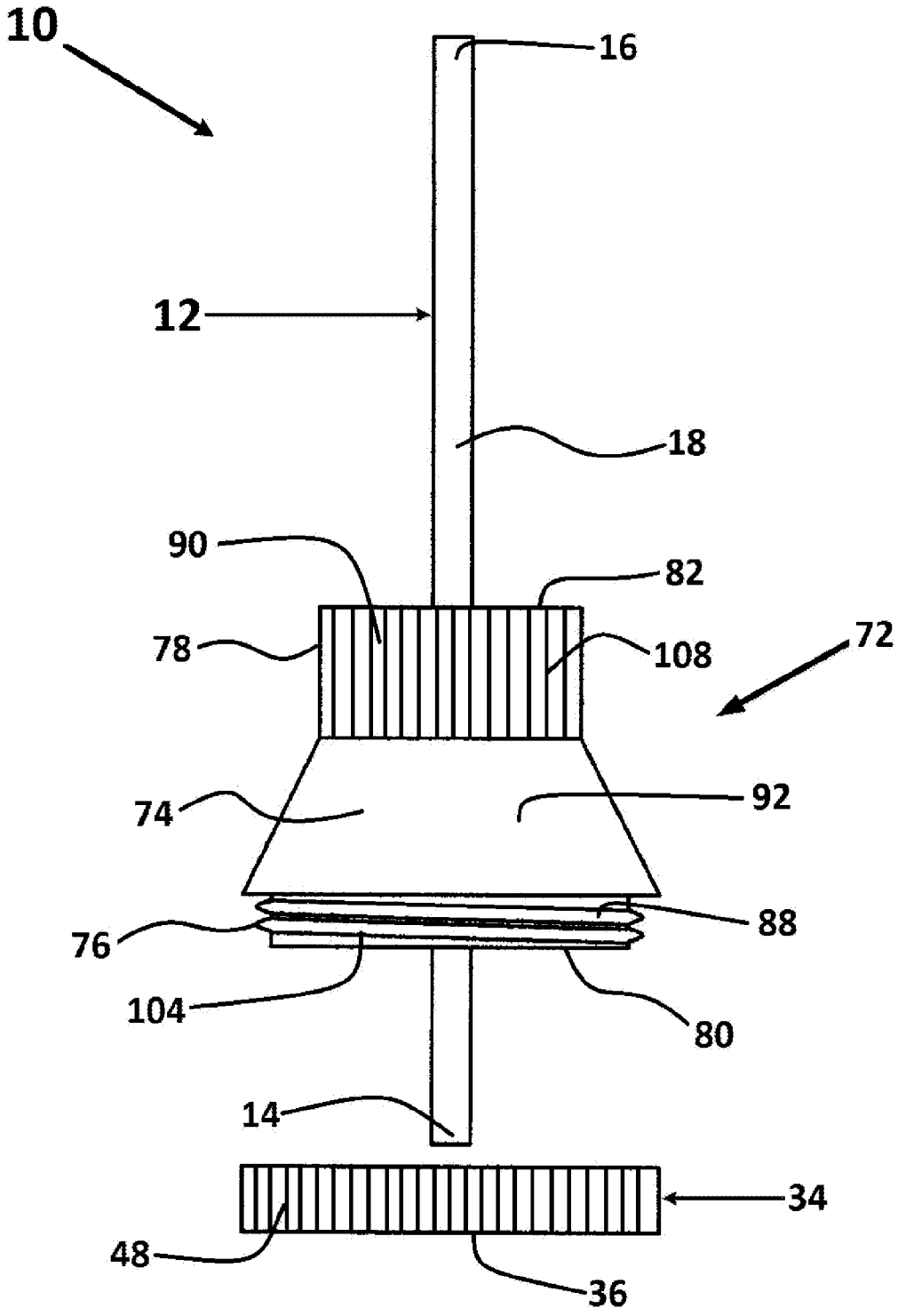
FIG. 2 is a front planar view of a portable shower of FIG. 1.
Figure 9:
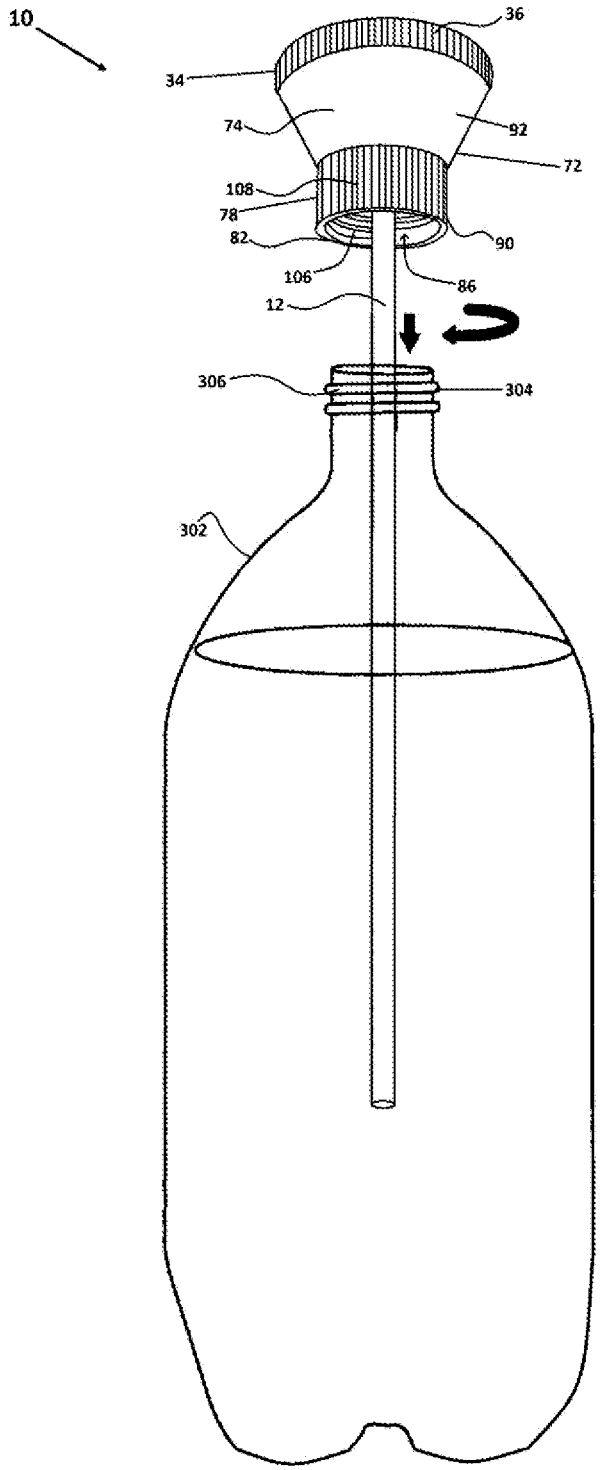
FIG. 9 is a perspective view of the portable shower in a closed position, also showing the air evacuator tube inserted into a fluid container according to a particular embodiment of the invention.
Figure 10:
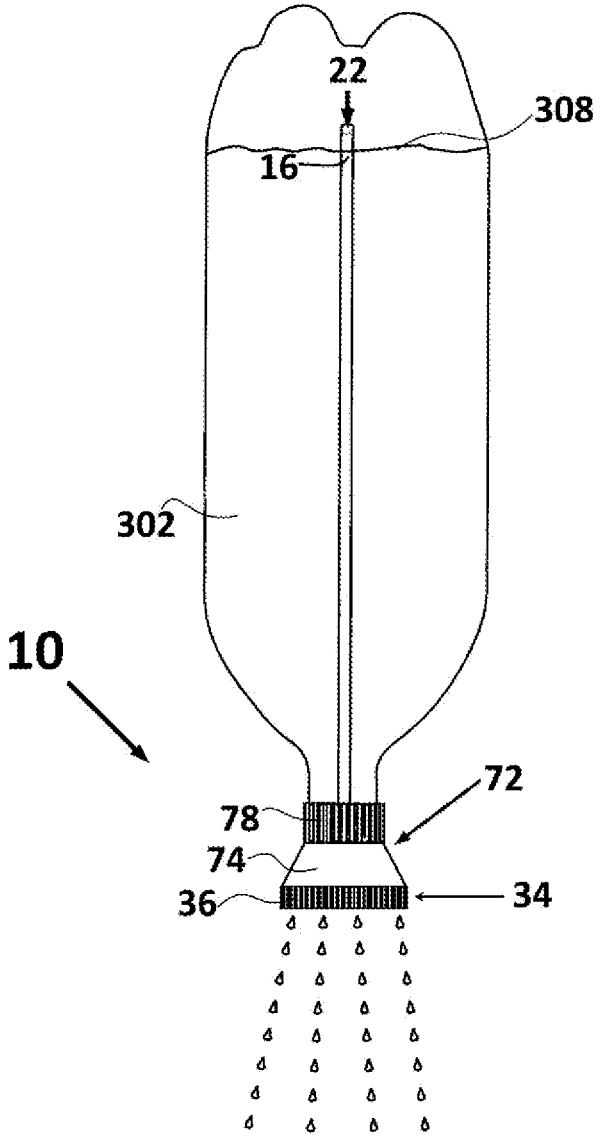
FIG. 10 is a side view of the portable shower removably coupled to the fluid container illustrating the portable shower in use according to an embodiment of the invention.
Figure 11A:
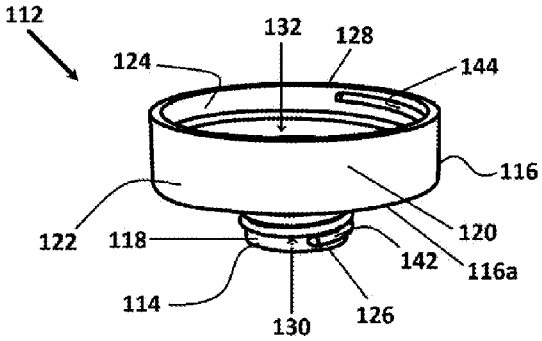
FIG. 11A is a top perspective view of a wide mouth adapter having a cap connector piece and a tubular connector piece according to an embodiment of the present invention.
Figure 11B:
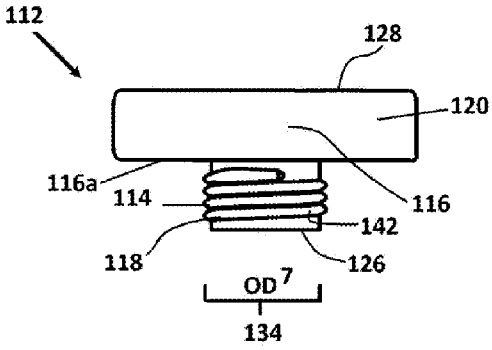
FIG. 11B is a side view of the wide mouth adapter.
Figure 11C:
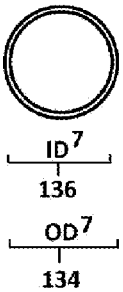
FIG. 11C is a cross section of the tubular connector piece of the wide mouth adapter.
Figure 11D:
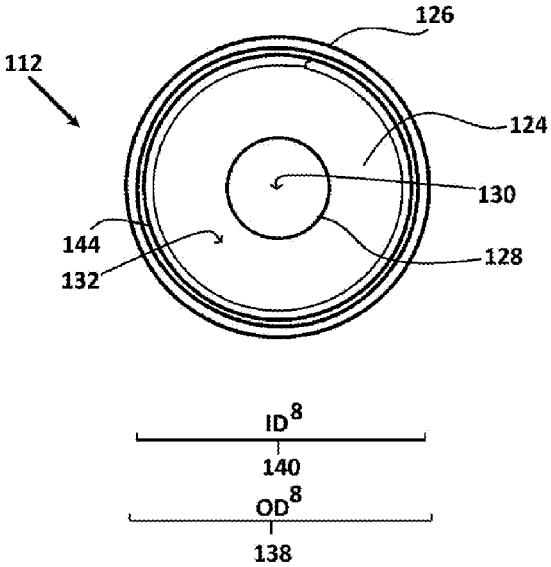
FIG. 11D is a top planar view of the wide mouth adapter.
Figure 22:
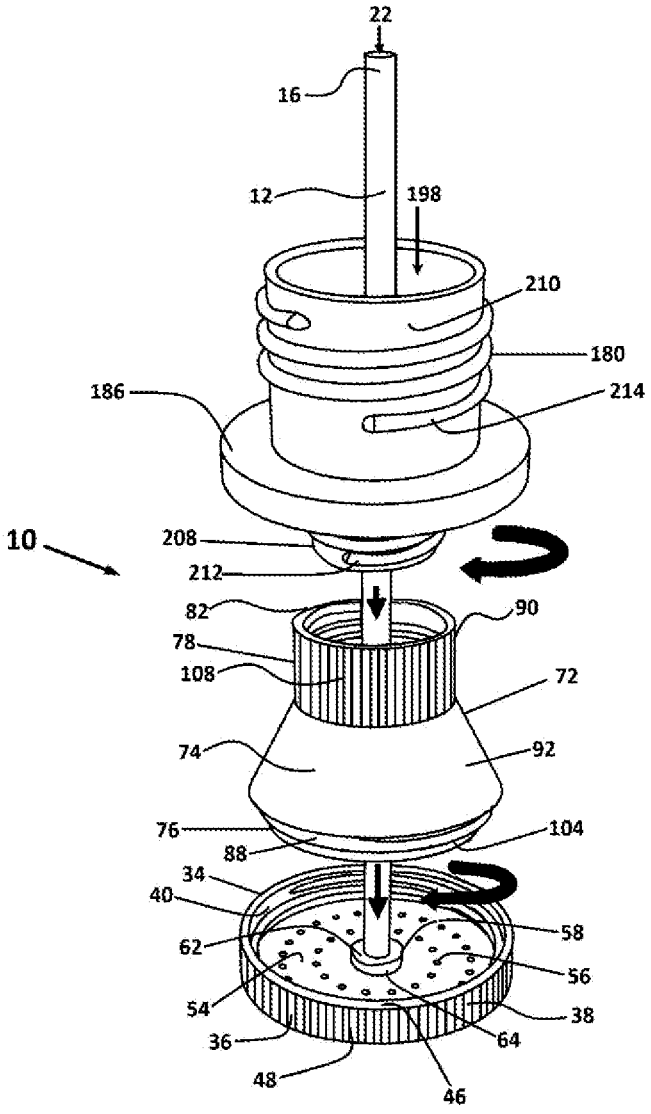
FIG. 22 is a perspective view of the portable shower and the flange tubular adapter showing the air evacuator tube extending through the openings of the flange tubular adapter according to an embodiment of the present invention.
Figure 23A:
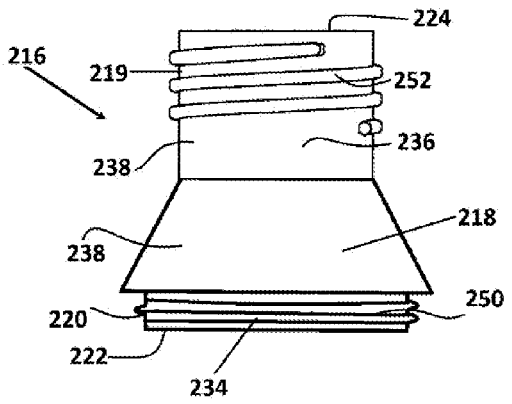
FIG. 23A is side planar view of a hybrid funnel adapter according to an embodiment of the invention.
Figure 23B:
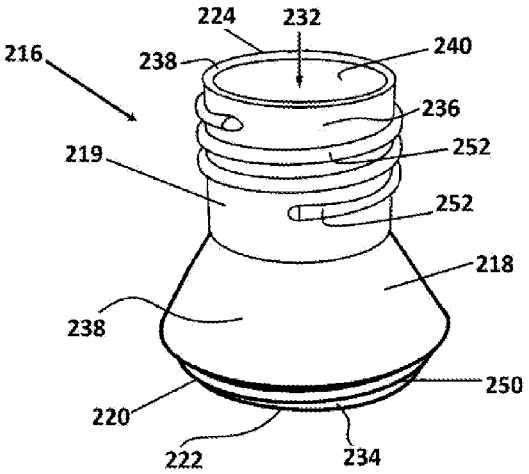
FIG. 23B is a perspective view of the hybrid funnel adapter.

The present invention provides a portable shower apparatus. Reference is made to FIGS. 1 and 2 which illustrates a portable shower apparatus 10 embodying features of the invention including an air evacuator tube 12; a shower head 34; funnel adapter 72. As shown in FIG. 1 and more particularly in FIG. 5A-5E the shower head 34 comprises a shower faceplate 54 circumvented by a ring connector collar 36. The shower faceplate 54 includes a plurality of fluid distribution holes 56 and a centrally located nipple connector 58 having a through bore 60. With reference to FIGS. 9-10 the shower head 34, funnel adapter 72, and a preexisting fluid container 302 are fluidly connected to each other via adapters. In another exemplary embodiment of the present invention, as shown in FIGS. 11A-11D and FIGS. 12-15 a wide container adapter 112 is described. Still further, as shown in FIGS. 16A-16D another exemplary embodiment of the present invention, a tubular adapter 146 is described. Still further, as shown in FIG. 21A-21D and FIG. 22, a flange adapter 180 is described and as shown in FIG. 23A-23 D and FIG. 24 a hybrid funnel adapter 216 is described.

Figure 8:
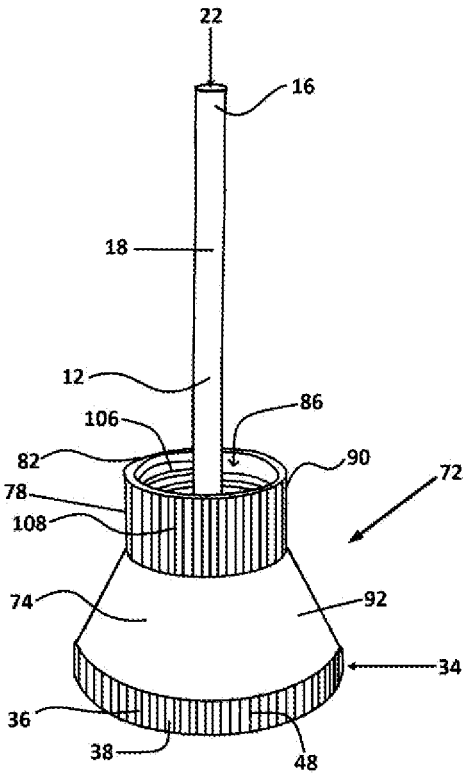
FIG. 8 is a perspective view of the portable shower wherein the shower head and the funnel adapter are removably coupled therewith in a closed position.

In operation, as shown in FIGS. 8-9 the portable shower 10 is easily coupled to the preexisting fluid container 302, for example a filled water bottle 302 that is particularly suited for handling the assembled portable shower 10 by hand. Generally, the threads of the funnel adapter 72, the wide container adapter 112, the tubular adapter 146, the flange adapter 180, the hybrid adapter 216 are compatible to standard container threads and thereby allow the adaptors 72, 112, 146, 180, and 216 to function in a variety of situations using a variety of standard preexisting fluid containers, for example, a 1 liter bottle, a Nalgene® Bottle, a Klean Kanteen, and any one of fluid containers having compatible threads with a corresponding adapter of any one of the funnel adapter 216, the wide container adapter 112, the tubular adapter 146, the flange adapter 180, the hybrid adapter 216, or any customized adapter to couple with a preexisting fluid container. The portable shower 10 may easily be utilized with fluid containers of a variety of sizes, for example, any one of a water bottle, a soda bottle, liter soda bottle, energy drink bottle, gallon milk bottle, gallon ice tea bottle, canteen, etc. The invention may advantageously be utilized as an outdoor washing apparatus in open spaces such as, for example, pools, beaches, gardens, campgrounds, disaster areas, etc. In operation, fluid, preferably water, can be heated by the solar radiation.

With particular reference to FIGS. 1-3 and later in FIGS. 8, 9, 10, 12-15, 17-20, 22 and 24, the air evacuator tube 12 extends centrally from the shower head 34, through the funnel adapter 72 in an operational position, for example, substantially vertical position. Further, the air evacuator tube 12 provides a passageway to deliver environmental air into a vessel of a preexisting fluid container, for example, a 1 liter bottle, a Nalgene® Bottle, a Klean Kanteen®. As shown in FIGS. 1-4C, the air evacuator tube 12 comprises a hollow linear flexible tube 12 having an exterior surface 18 and an interior surface 19; a first end 14 and a second end 16; two opposing openings 20 and 22 having substantially equal diameters, a first opening 20 and a second opening 22, the first opening 20 is an air intake and the second opening 22 is an air outlet. The exterior surface 18 of the air evacuator tube 12 houses a center hollow passage through which environmental air can be routed from the intake opening 20 of the air evacuator tube 12 to the outlet opening 22 of the air evacuator tube 12. The air evacuator tube 12 includes an outer diameter [$OD^1$] 24 and an inner diameter [$ID^1$] 26 wherein the outer diameter outer diameter [$OD^1$]24 is slightly greater than the inner diameter inner diameter [$ID^1$]26. Further, the outer diameter [$OD^1$] 24 is dimensioned equal to or slightly less than the inner diameter [$ID^4$] 70 of the cylindrical connector bore 60 of the shower faceplate 54, as illustrated in FIGS. 5A-5E so that, when assembled, the air evacuator tube 12 as described in more detail below in FIGS. 5A-5E, configured to prevent the air evacuator tube 12 extending too far through the nipple bore 60 during use of the portable shower 10. The air evacuator tube 12 can be dimensioned with an outer diameter [$OD^1$] of approximately 0.20 mm 30 mm and having an [$ID^1$] slightly less than the [$OD^1$].

As shown in FIG. 3A the air evacuator tube 12 is configured of predetermined length L1 slightly less than the depth of the preexisting water container to which it is inserted therein, as more particularly shown in FIGS. FIGS. 8, 9, 10, 12-15, 17-20, 22 and 24. The air evacuator tube 12 can be dimensioned with a length of approximately 30 cm to correspond to the depth of the fluid container to which it is coupled. In another embodiment, an air evacuator tube 12 may be utilized having a length such that the air evacuator tube 12 is approximately slightly less than a length of a larger fluid container, for example, a liter bottle.

As shown in FIGS. 4A-4C, another embodiment of the present invention, the air evacuator tube 12 can include a stop 28. More particularly, FIG. 4B-4C shows a stop 28 having a through bore 28*a* having an outer diameter [$OD^2$] [30] and an inner diameter [$ID^2$] 32. The stop is ring shaped and disposed around the air evacuator tube 12 proximal to the first end 14 of the air evacuator tube 12. As shown in FIG. 4B the stop 28 is configured with an internal bore 28*a* having an inner diameter [$ID^2$] slightly greater than the outer diameter [$0D^1$] of the air evacuator tube 12 which allows for a snug fit of the first end 14 of the air evacuator tube 12 inserted within the bore 28*a* stop 28. The stop 28 is configured with an outer diameter [$OD^2$] 30 approximately equal to or slightly less than the inner diameter [$ID^4$] of the cylindrical connector nipple bore 60 of the shower faceplate 54, as described in more detail below in FIGS. 5A-5E, configured to prevent the air evacuator tube 12 extending too far through the nipple bore 60 during use of the portable shower 10.

In another embodiment the air evacuator tube 12 may be rigid.

Thus, as can be best seen in FIGS. 1, 2, 6A, 6B, 8, 9, 10, 12, 13, 14, 15, 18 the air evacuator tube 12 extends from the portable shower's 10 shower face plate 54 throughin the funnel adapter 72 and throughin any one of additional adapters the wide container adapter 112, the tubular adapter 146, the flange adapter 180, the hybrid adapter 216 embodied by the present invention. Further the air evacuator tube 12 provides a passageway to guide the passage of air from the environment to the inner vessel of the fluid container. Moving ahead with reference to FIGS. 6B, 10, 15, 20, showing the portable shower 10 in use, as described in me detail below, the portable shower 10 can be removably coupled to a preexisting fluid container 302, 310 or 316 filled with water; as environmental air enters through the air evacuator tube inlet 20 and is released through the air evacuator outlet 22 into the vessel of the fluid container 302, 310 or 316 water contemporaneously flows through the funnel adapter 72 through the shower head 34 and expelled through the fluid distribution holes 56 of the shower faceplate 54. The air is released through the air evacuator tube outlet 22 to replace the space previously occupied by the water held by the fluid container.

The air evacuator tube 12 may be formed in any suitable manner but preferably is injection mold technique from polymeric materials including any one of acrylonitrile butadiene styrene (ABS), polyvinyl chloride (PVC), or polyethylene (PE), or polybutylene (PB). In a preferred embodiment of the present invention, the air evacuator tube 12 is fabricated from ABS or PE using injection-mold technique.

With reference to FIGS. 1, 5A-5C, and FIG. 6A-6B the shower head 34 is subdivided into a housing body 36 and a shower face plate 54. The housing body is formed by a ring connector collar 36 circumventing the shower face plate 54; ring connector collar 36 having an outer diameter [$OD^3$] and inner diameter [ID3]. The ring connector collar 36 includes an exterior circumferential wall 38 having height wherein the wall 38 includes a circumferential top edge 46 and a circumferential base edge 46*a*. In addition, the ring connector collar 36 has an interior wall 40 wherein the interior wall 40 includes interior threads 52 providing a connector element that is compatible with the exterior threads 104 of the cylindrical connector piece 88 of the funnel adapter 72, as described in more detail below. The cylindrical base edge 46*a* of the ring connector collar 36 is intricately flush to the circumferential edge of the shower face plate 54. An interior space is formed substantially equal to the depth of the ring connector collar wall 38.

Figure 5A:
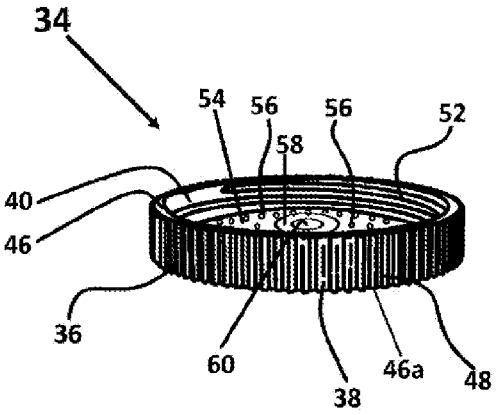
FIG. 5A is a top perspective view of the shower head.
Figure 5B:
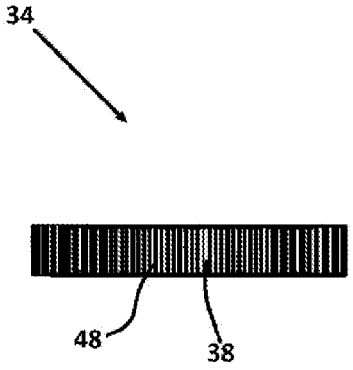
FIG. 5B is a side planar view of the shower head.
Figure 5C:
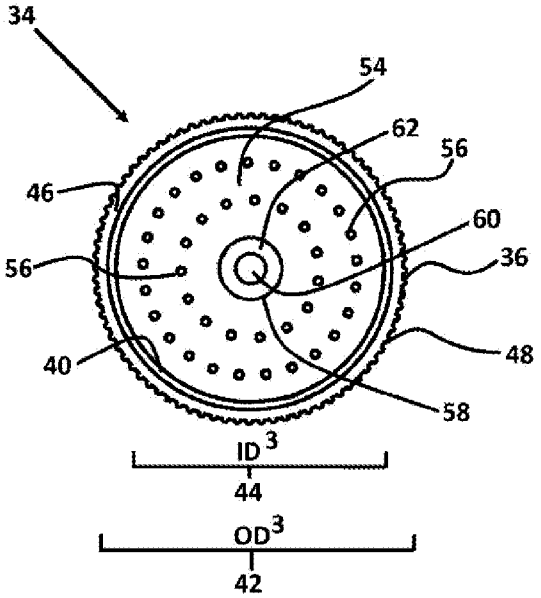
FIG. 5C is a top planar view of the shower head, also, showing a cylindrical connector nipple.
Figure 5D:
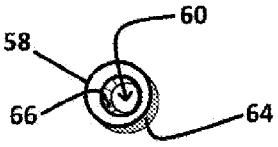
FIG. 5D is a top perspective view of the connector nipple.
Figure 5E:
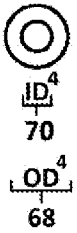
FIG. 5E is a cross sectional view of the connector nipple.
Figure 6A:
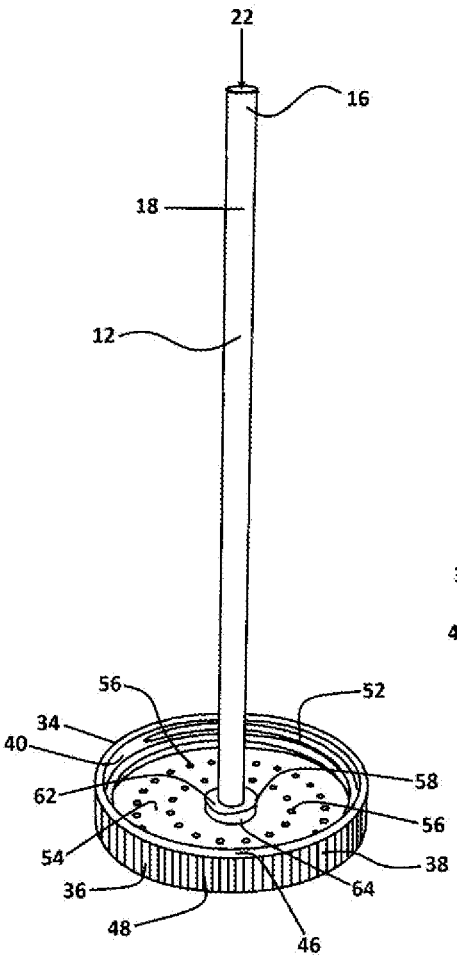
FIG. 6A is a top perspective view of the air evacuator tube inserted in the shower head.
Figure 6B:
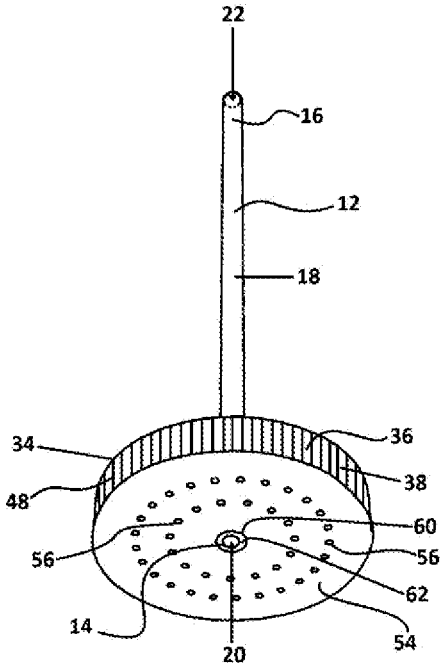
FIG. 6B is a bottom perspective view of the air evacuator tube inserted in the shower head.
Figure 27:
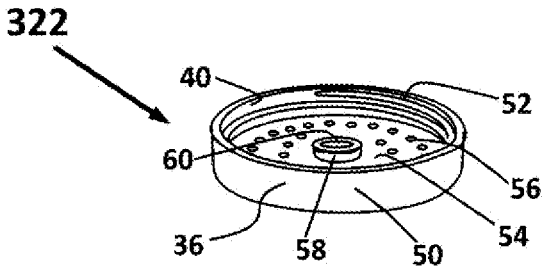
FIG. 27 is a top perspective view of a shower head with a smooth exterior surface according to an embodiment of the present invention.

As shown, in FIGS. 5A-5 E and FIGS. 6A-6B the shower head 34 characterized in that the collar connector piece 36 is configured as a cylindrical connection piece with interior threads 52 disposed for being compatibly received by the funnel adapter 72 cylindrical connector piece 88 which is provided with exterior threads 104 which limits the twistability of the collar connector piece 36 in relation to the funnel cylindrical connector piece 88 in (at least one—two—three) directions of rotation. According to a preferred embodiment of the present invention, the ring connector collar 36 can dimensioned with an outer diameter [$OD^3$]42 approximately 50.00 mm, and inner diameter [$ID^3$] 44 approximately 45.00 mm; and wall height dimensioned approximately 8.00 mm. In the exemplary embodiment, the shower head includes a ribbed 48 exterior wall 38. In another embodiment of the invention, as shown in FIG. 27 the exterior wall of the shower head 34 has a smooth 50 exterior surface.

Further, the shower face plate 54, according to a preferred embodiment of the present invention, is a thin round plate provided with a plurality of fluid distribution holes 56 extending therethrough; and a centrally disposed cylindrical connector nipple 58 having a bore 60 bounded by a nipple rim 62 extending upwards from the shower face plate 54. The shower plate 54 in the preferred embodiment of the present invention is generally flat and dimensioned so that its circumferential edge is flush with the circumferential base edge 46*a* of the interior wall 40 of the ring connector collar 36. In another embodiment of the present invention the shower face plate 54 can be oval or domed.

Further, the fluid distribution holes 56 can be disposed therein in a variety of configurations including any one of straight or angled throughin the shower faceplate 54. The fluid distribution holes 56 may be arranged in any of a variety of configurations including any one of radial arrays, concentric arrays, and the like. The fluid distribution hole 56 arrangements may result in varying hole density through the thickness shower faceplate 54. Different diameters of fluid distribution holes 56 may be used in different locations depending on the fluid flow desired or needed. In one embodiment approximately 40 fluid distribution holes 56 perforate across the shower faceplate 54; the fluid distribution holes 56 are all of the same nominal diameter and patterned in circles distanced equally apart from each other. The fluid distribution holes 56 may also vary in diameter through the thickness of the shower faceplate 54. For example, the fluid distribution holes 56 may be a first diameter on the front of the face plate and be of a different diameter on the back of the shower faceplate 54. The first diameter may be larger than the second diameter.

In the preferred embodiment, the shower faceplate 54 is dimensioned with a thickness of approximately 2.00 mm, but not limited to. The inner diameter of the fluid dispensing holes are approximately 1.00 mm, but not limited to. Further, the face plate can include generally 40 fluid distribution holes 56.

The shower head 34, shower faceplate 54, and cylindrical connector nipple 58 may be fore any suitable manner but preferably is injection mold technique from polymeric materials including any one of acrylonitrile: butadiene styrene (ABS), polyvinyl chloride (PVC), or polyethylene (PE), or polybutylene (PB). In a preferred embodiment of the present invention, the shower head and face plate is fabricated from ABS or PE using injection-mold technique.

As shown in FIGS. 5D and 5E the connector nipple bore 60 includes an outer diameter [$OD^4$] 68 and an inner diameter [$ID^4$] 70. The bore inner diameter [$ID^4$] 70 is slightly less than the outer diameter [$OD^1$] 24 of the air evacuator tube 12 to provide for a snug fit of the air evacuator tube 12 during the insertion of the air evacuator tube 12 therein the connector nipple bore 60, as shown in FIGS. 6A and 6B. As shown, the air evacuator tube 12 is inserted throughin the nipple bore 60 such that the inlet 20 of the air evacuator tube 12 is open to the environment allowing environmental air to be delivered up into the air evacuator tube 12.

As best illustrated in FIGS. 1, 2, 7A-7D the funnel adapter 72 is generally a threaded transition adapter for use with a preexisting fluid container and for use with the shower head 34 of the portable shower 10 of the present invention. As illustrated in FIGS. 9 and 10 the fluid container can be a preexisting 1 liter water 302 bottle having a threaded tubular neck connector piece 304 to which the funnel adapter 72 can be removably threadably coupled therewith.

Figure 7A:
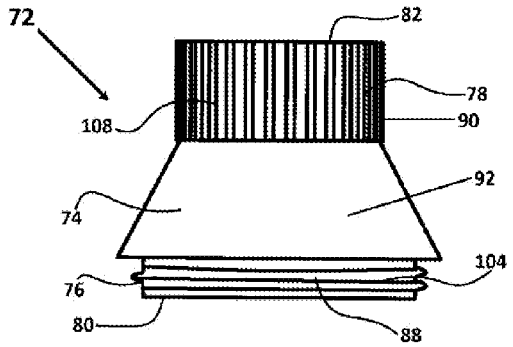
FIG. 7A is a side planar view of a funnel adapter according to a particular embodiment of the invention.
Figure 7B:
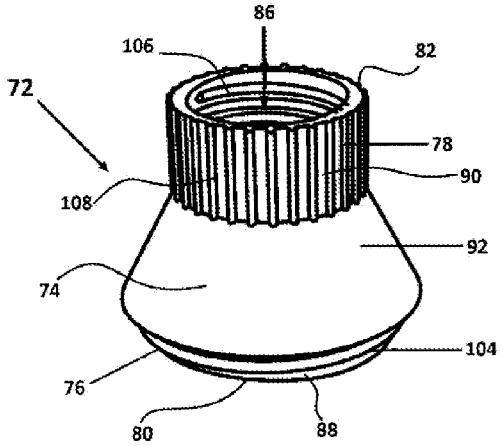
FIG. 7B is a perspective view of the funnel adapter.
Figure 7C:
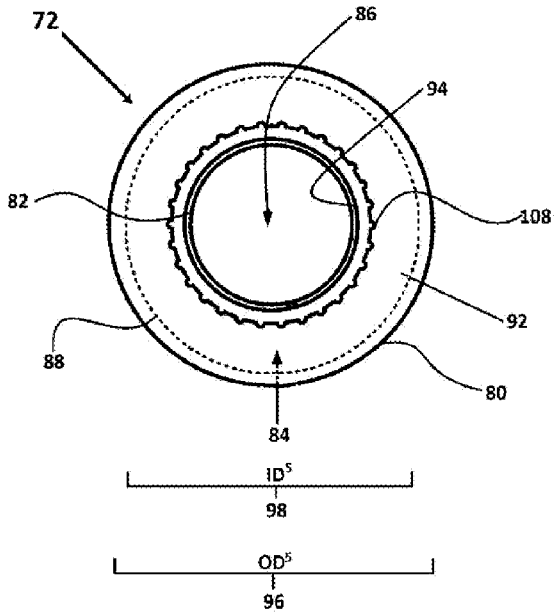
FIG. 7C is a planar view of the funnel adapter.
Figure 7D:
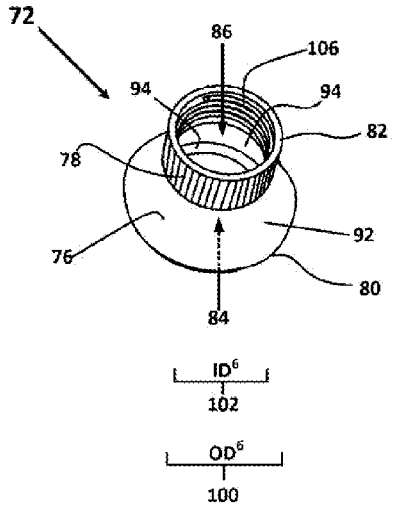
FIG. 7D is a top perspective view of the funnel adapter.

The funnel adapter 72 in accordance with the preferred embodiment of the present invention is a transition adapter comprising a single body having a conical portion 74; a tubular portion 78; and a cylindrical portion 76. The funnel adapter 72 further includes a first end 80 and a second end 82; two opposing openings 84 and 86, a first opening 84 and a second opening 86 wherein the first opening 84 is dimensioned approximately greater in diameter than the second opening 86. More particularly, as shown in FIGS. 7C-7D the first opening 84 includes an outer diameter [$OD^5$] 96 and an inner diameter [$ID^5$] 98 and the second opening 86 includes an outer diameter [$OD^6$] 100 and an inner diameter [$ID^6$] 102.

In the preferred embodiment, the conical portion 74 formed having an exterior wall surface 92 and an interior wall surface 94 therewith houses an interior conical hollow space which provides passage of uninterrupted flow of fluid when the portable shower 10 is in operation. The conical portion 74 is sloped extending from the tubular portion 78 to the cylindrical portion 76. The exterior surface 92 and the interior surface 94 of the conical portion 74 is preferably smooth.

Further as shown in FIGS. 1, 2, 7A-7D the cylindrical connection portion 76 extends from the first end of the conical portion 74 wherein the cylindrical connection 76 portion is dimensioned with an outer diameter [$OD^5$] 96 slightly less than the widest diameter of the conical portion 74. The cylindrical connection portion 76 includes a cylindrical connection piece 88 which houses an interior cylindrical hollow space (not shown) co-axial to the interior conical hollow space (not shown) to provide passage of uninterrupted flow of fluid. More particularly, in the preferred embodiment of the present invention, the cylindrical connection piece 88 includes the first opening 84 having a greater diameter than the second opening 86 of the funnel adapter 72. The cylindrical connection piece 88 includes exterior threads 104. The external threads 104 extend along a full length of the cylindrical connector piece 88. As shown in FIG. 1 the exterior threads 104 of the cylindrical connector piece 88 are configured to rotably interfit and threadably couple upon rotating with the compatible interior threads 52 of the ring connector collar 36 of the shower head 34. As shown in FIG. 8 the shower head 34 abuts the edge of the funnel adapter 72 when the ring collar connector 36 is fully securely engaged to the threaded cylindrical connector piece 88 of the funnel adapter 72.

Further, as shown in FIGS. 1, 2, 7A-7D a tubular portion 78 extends from the conical portion 74 of the funnel adapter 72. The tubular portion 74 includes a tubular connector piece 90 formed having a circumferential opening 86 having an outer diameter [$OD^6$]100 less than the outer diameter [$OD^5$] 96 of the first opening 84. The tubular connector piece 90 houses an interior cylindrical hollow space which is through co-axial with the conical hollow space and cylindrical hollow space (not shown) which provides a passage of uninterrupted flow of fluid from the preexisting fluid container when the portable shower 10 is in use. As shown in FIG. 9 the tubular connector piece 90 includes interior threads 106 configured to rotatably interfit and threadably couple with the exterior threads 306 on the tubular neck 304 of a preexisting fluid container. In an embodiment of the invention, the fluid container is a conventional 1 liter water bottle 308, but not limited to. The dimensions of the interior of the tubular connector piece 90 is configured for threadably engaging an exterior threaded neck 304 of the preexisting water bottle 308, so that no re-tooling of the manufacturing of the water bottle containers is required.

In a preferred embodiment the tubular connector piece 90 is dimensioned with a second opening 86 having an outer diameter ($OD^6$) approximately 31.00-31.500 mm and having a length approximately 16.00 mm. In a preferred embodiment of the invention, the interior threads 106 of the tubular connection piece 90 is configured to rotably interfit with the exterior threads 306 of the tubular neck 304 of a preexisting conventional water bottle and are compatible therewith so that the tubular connector piece 90 of the funnel adapter 72 upon rotating and the neck 304 of the preexisting water bottle can be securely threadably connected to each other, as shown in FIG. 10.

Figure 28:
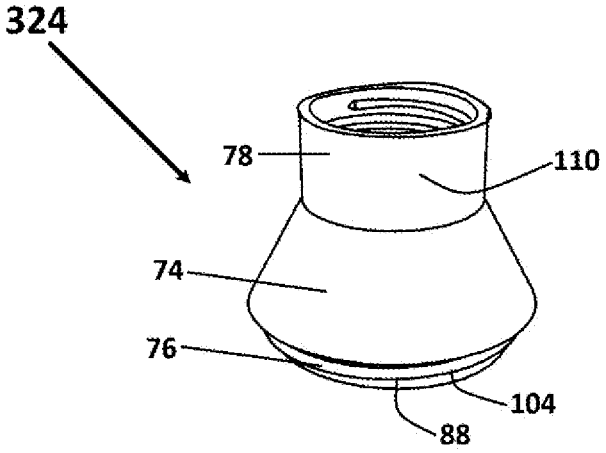
FIG. 28 is a top perspective view of a funnel adapter with a smooth exterior surface according to an embodiment of the present invention.

In this exemplary embodiment the tubular connector portion 78 of the funnel adapter 72 is ribbed 108. In another embodiment of the invention, as shown in FIG. 28 the tubular connector portion 78 is smooth 110.

The funnel adapter 72, according to an embodiment of the present invention, includes a first opening configured with an outer diameter approximately 45.00 mm; interior diameter approximately 16.00 mm. The funnel adapter and the ring collar connector have a combined height of 4.3 cm.

The funnel adapter 72 of the present invention provides a secure connection between a shower head 34 at the first end 80 of the funnel adapter 72 and a secure connection at the second end 82 of the funnel adapter 82 with the preexisting fluid container, for example, a 1 liter bottle 302 for use over extended periods since is little or no tendency for the adapter to crack during the mounting of the shower head or the preexisting fluid container.

In another embodiment of the invention, as shown in FIGS. 11A-11D the wide container adapter 112 has been found desirable for use with water containers having a neck with an opening having a larger diameter than the externally threaded neck opening of a conventional water bottle, for example a 1 liter bottle, and more particularly having a neck having an exterior surface having threads thereon, for example a Nalgene® Bottle. Thus, as further shown in FIGS. 12-15 the wide container adapter 112 relates to a transition adapter for use with a preexisting wide mouth container 310, for example a Nalgene® Bottle and the funnel adapter 72 of the portable shower 10 apparatus.

The wide container adapter 112 in accordance with an embodiment of the invention is a transitional adapter comprising a single body including a cylindrical connector portion 116 and a tubular connector portion 114 seamlessly connected thereto; and hollow space (not shown) therethrough to allow uninterrupted flow of fluid. The wide container adapter 112 further includes a first end 126 and a second end 128; two opposing openings 130 and 132, a first opening 130 and a second opening 132 wherein the first opening 130 is dimensioned approximately less in diameter than the second opening 132. More particularly, as shown in FIGS. 11A-11D the first opening 130 has an outer diameter [$OD^7$] 134 and has an inner diameter [$ID^7$] 136; the second opening 132 has an outer diameter [OD] and has an inner diameter [ID].

The tubular connector piece 118 of the wide connector adapter 112 is dimensioned with an outer diameter ($OD^7$) approximately 27.00 mm.

Figure 12:
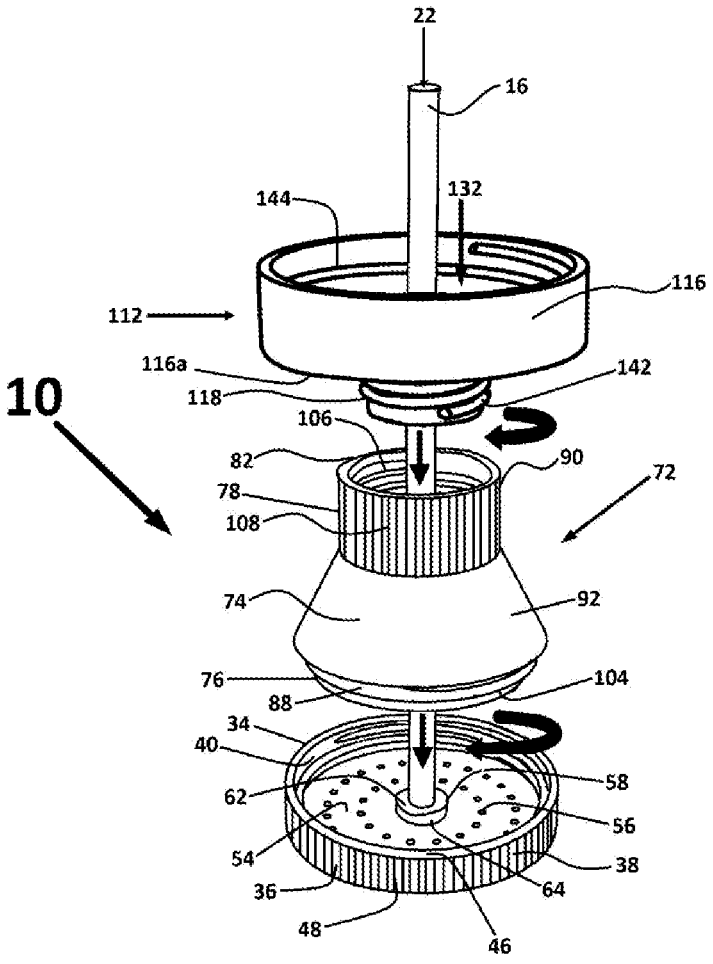
FIG. 12 is a side perspective view of the portable shower showing the air evacuator tube extending throughin the openings of the wide mouth adapter.
Figure 13:
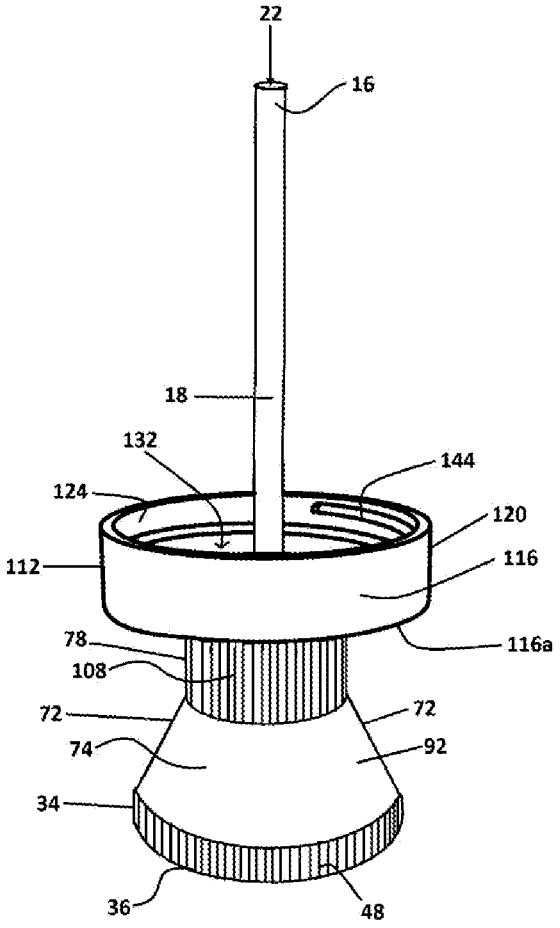
FIG. 13 is a perspective view of the portable shower removably coupled with the wide mouth adapter in a closed position.

The tubular connector portion 114 includes a tubular connector piece 118 having the second opening 132 coaxial with the first opening 130. As shown in FIGS. 12 and 13 the tubular connector piece 118 includes an exterior surface 122 and interior surface 124; the exterior surface 122 housing an interior tubular hollow space (not shown) which provides a passage of uninterrupted flow of fluid. The tubular connector piece 118 exterior surface 122 is threaded 142 configured to rotatably interfit and threadably removably couple with the interior threaded 106 tubular connector piece 90 of the funnel adapter 72. In an embodiment of the invention, threaded 142 external surface 122 of the tubular connector piece 118 of the wide container adapter 112 is adapted to interfit with the interior threaded 106 tubular connector piece 90 of the funnel adapter 72.

The length of the tubular connector piece 118 of the wide mouth adapter 112 is such that funnel tubular connector piece abuts the bottom surface of the cap plate of the wide container adapter 112 when the funnel tubular connector piece 90 is fully engaged to the compatible exterior threaded 142 tubular connector piece 118 of the wide mouth adapter 112.

The cylindrical connector portion 116 of the wide container adapter 112 extends radially along a circumferential base plate 116*a* from the tubular connector piece 118 of the wide container adapter 112. A cap connector piece 120 formed by an exterior wall surface 122 and an interior wall surface 124 wherein the interior surface 124 includes threads 144. The external wall surface 122 of the cap connector portion 120 is smooth. In another embodiment the external wall surface 122 of the cap connector portion 120 can be ribbed (not shown).

The cap connector piece 120 includes open space terminated by circumferential exterior wall 122*a* limited at the first end 126 and the base plate 116*a*. The circumferential base plate 116*a* includes the centrally located opening 130 of the tubular connection piece 118.

Figure 14:
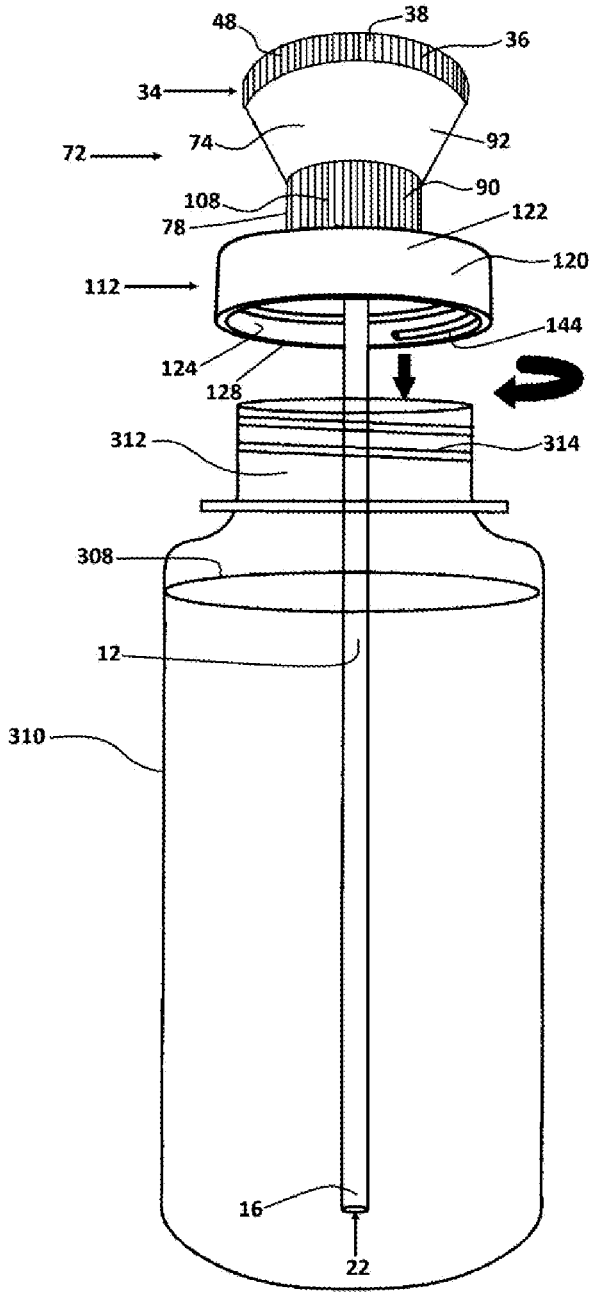
FIG. 14 is a perspective view of the portable shower removably coupled with the wide mouth adapter showing the air evacuator tube inserted into a fluid container according to an embodiment of the present invention.
Figure 15:
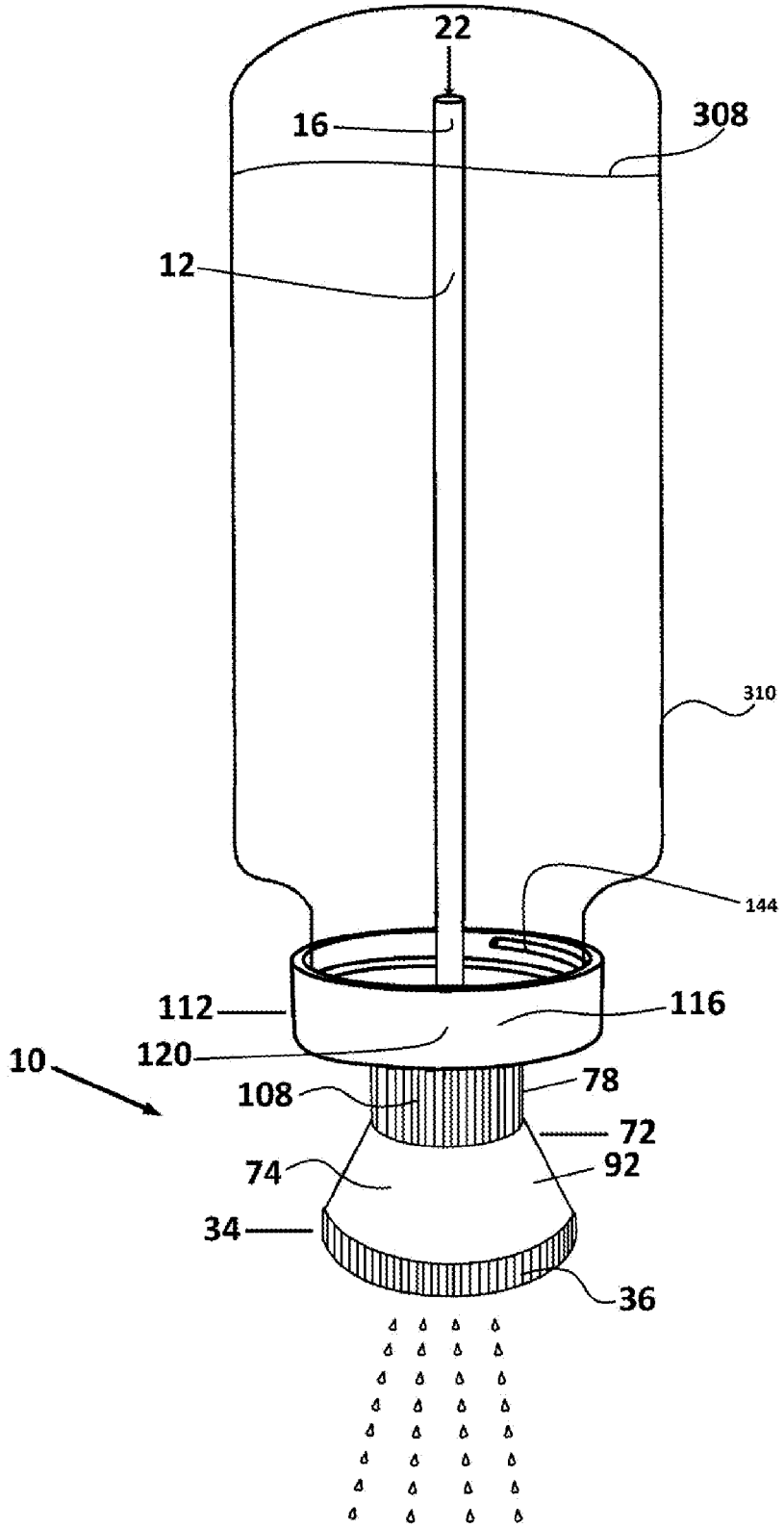
FIG. 15 is a side view of the portable shower removably coupled to the wide mouth adapter which is removably coupled to the fluid container illustrating the portable shower in use according to an embodiment of the invention.

In an embodiment of the invention, as shown in FIGS. 14 and 15 the threaded 144 interior 124 of the cap connector piece 120 is adapted to interfit with the exterior threads 314 of the neck 312 of a preexisting conventional wide mouth fluid container 310 and are compatible therewith so that the cap connector piece 120 upon rotating and the neck 312 of the preexisting wide mouth water container 112 can be securely removably threadably connected to each other to form a secure connection.

The exterior threads 142 of the tubular connector piece 118 of the wide container adapter 112 are adapted to interfit with the interior threads 106 of the tubular connector piece 90 of the funnel adapter 72 and are compatible therewith so that the tubular connector piece 90 of the funnel adapter 72 upon rotating and the exterior threads 142 of the tubular connector piece 118 of the wide container adapter 112 can be securely removably threadably connected to each other to provide for a secure portable shower 10 as shown in FIG. 15.

The wide mouth adapter 112 of the invention provides a secure connection between the portable shower 10 and the preexisting fluid container 310, for example, a Nalgene® Bottle, for use over extended periods. There is little or no tendency for the adapter to crack during the mounting of the portable shower removably connected to the wide mouth adapter 112 or the preexisting fluid container.

In another embodiment of the invention, a tubular adapter 146, as shown in FIGS. 16A-16D, and FIGS. 17-20 is configured compatible with the funnel adapter 72 on a first end 156 and a pre-existing fluid container on a second end 158. In this embodiment, the first tubular connector portion 148 is coaxial with the second tubular portion 150. The tubular adapter 146 has been found desirable for use with fluid containers having a neck opening having an internal surface with internal threads thereon. Thus, the tubular adapter 146 relates to a transition adapter for use juxtaposed between a preexisting fluid container having interior threaded neck and the funnel adapter 72 of the portable shower 10. In this exemplary embodiment, the fluid container can be a Klean Kanteen®.

The tubular adapter 146 comprises a single body including two tubular connector portions 148 and 150 extending coaxially, a first tubular portion 148 and a second tubular connector portion 150, the first tubular connector portion 148 includes a first opening 160 and the second tubular portion 150 includes a second opening 162. Referring to FIGS. 16A-16D the outer diameter [$OD^9$] of the first tubular opening 160 is less than the outer diameter [$OD^{10}$] of the second tubular opening 162. Further, the length of the first tubular connector portion 148 is less than the length of the second tubular connector portion 150 of the tubular adapter 146. The tubular adapter has an exterior wall surface 152 and an interior wall surface 154.

As shown in FIG. 16B, the first tubular connector portion 148 includes a first tubular connector piece 172 having a first opening 160 coaxial with the second opening 162. The exterior wall surface 152 houses an interior tubular hollow space (not shown) for passage of uninterupted flow of fluid. The first tubular connector piece 172 exterior wall surface 152 is threaded 176 configured to interfit and removably threadably couple with the interior threads 106 of the tubular connector piece 90 of the funnel adapter 72. In the exemplary embodiment of the invention, the exterior threads 176 of the first tubular connector piece 172 of the tubular adapter 146 are configured to interfit with the interior threads 106 of the tubular connector piece 90 of the funnel adapter 72 of the portable shower 10.

Figure 17:
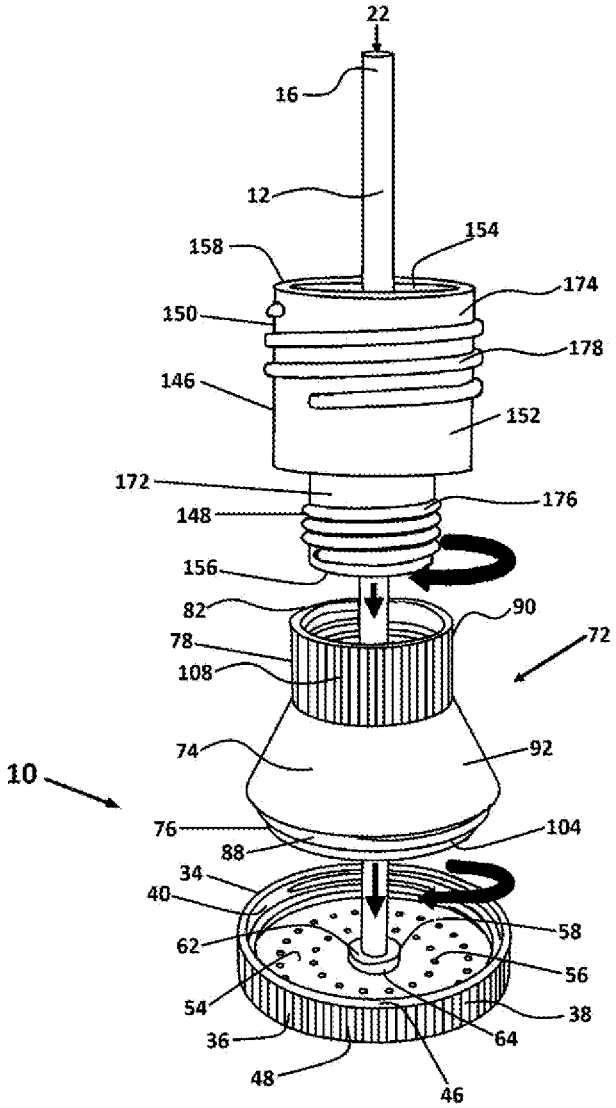
FIG. 17 is a perspective view of the portable shower and the tubular adaptor showing the air evacuator tube with the air evacuator tube extending throughin the openings of the tubular adapter according to an embodiment of the invention.
Figure 18:
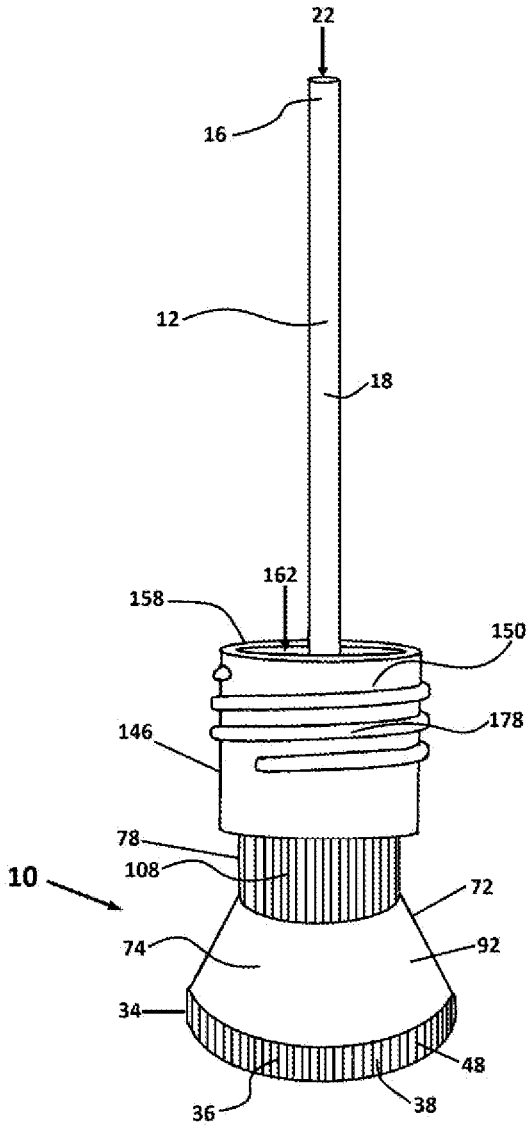
FIG. 18 is a side perspective view of the portable shower removably coupled to the tubular adapter in a closed position.
Figure 20:
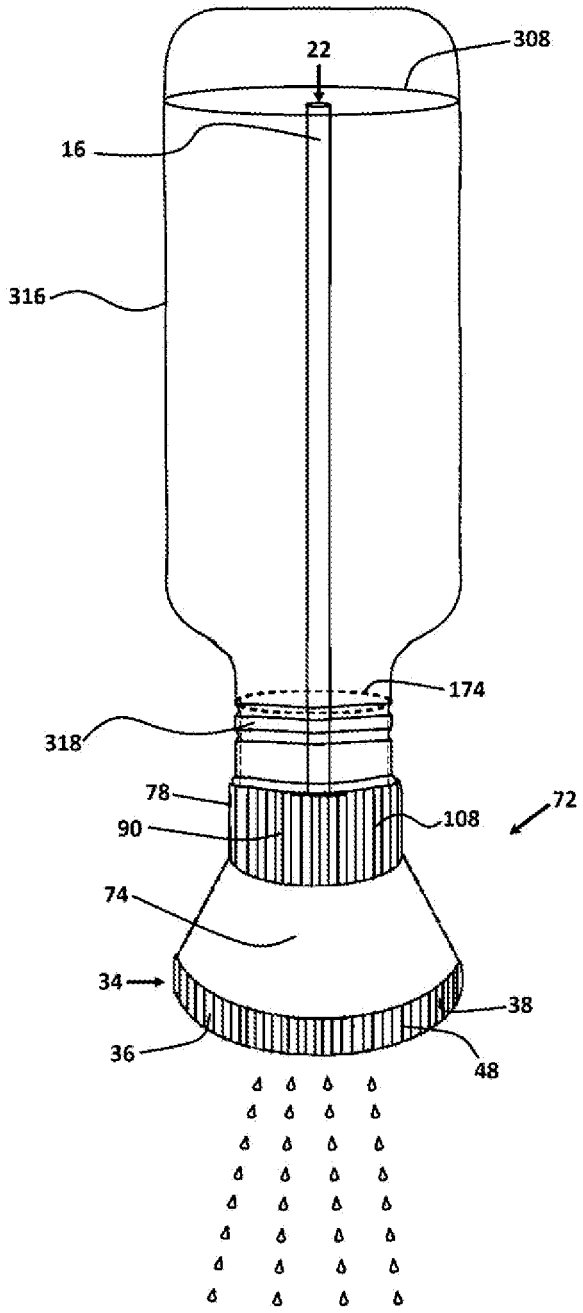
FIG. 20 is a side view of the portable shower removably coupled to the tubular adapter in the closed position removably coupled to the fluid container illustrating the portable shower in use according to an embodiment of the invention.

In an exemplary embodiment of the invention, as shown in FIG. 17 the exterior threads 176 of the first tubular connector piece 172 are configured to interfit with the interior threads 106 of the tubular connector piece 90 of the funnel adapter 72 and are compatible therewith so that the tubular connector piece 90 of the funnel adapter 72, as shown further in FIG. 18, upon rotating upon the exterior threads 176 of the first tubular connector piece 172 of the tubular adapter 146 can be securely threadably connected to each other to provide for a secure portable shower 10, as shown in FIG. 20.

Figure 19:
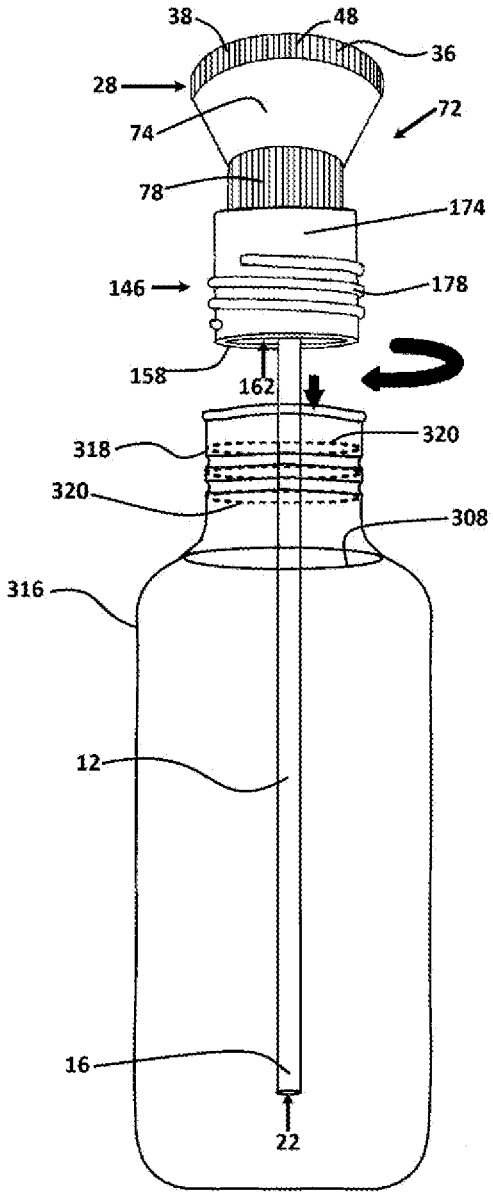
FIG. 19 is a perspective view of the portable shower removably coupled to the tubular adapter showing the air evacuator tube inserted into a fluid container according to an embodiment of the present invention.

Coaxial to the first tubular portion 148 the second tubular portion 150 of the tubular adapter 146 includes a second tubular connection piece 174 having a second opening 162 having an outer diameter [$OD^{10}$] 168 greater than the outer diameter [OD9]164 of the first opening 160 of the first tubular connector piece 172 of the tubular adapter 146. More particularly, as shown in FIGS. 16A-16B the second tubular connection piece 174 houses an interior tubular hollow space which is co-axial with the second tubular hollow space which provides a passage of uninterrupted flow of fluid from a preexisting water container, as shown in FIG. 20. Further, as shown in FIG. 19, the second tubular connector piece 174 includes exterior threads 178 configured to rotatably interfit and threadably removably couple with the a preexisting fluid container 316 having a neck 318 opening with interior threads 320. In an exemplary embodiment, the preexisting fluid container is a Klean Kanteen®. As shown in FIGS. 19 and 20 the exterior threads 178 of the second tubular connector piece 174 extend along a length of the exterior wall surface 152 of the second tubular connector piece 174 such that the second tubular connector piece 174 is configured for engaging the interior threads 320 of the neck 318 of the fluid container 316 when the second tubular connector piece 174 is interfitted to the neck 318 of the fluid container 316 such that the fluid container neck 318 envelops the second tubular connector piece 174 when the second tubular connector piece 174 is fully threadably coupled with the neck 318 of the fluid container 316. The dimensions of the interior diameter [$ID^{10}$] 168 of the second tubular connector piece 174 is configured for threadably engaging the interior threaded 320 of the neck 318 of preexisting fluid container 316, so that no re-tooling of the manufacturing of the fluid container 316 is required.

In the exemplary embodiment of the invention, as shown in FIG. 19, the exterior threads 178 of the second tubular connector piece 174 are adapted to interfit with the interior threads 320 of the neck 318 portion of the preexisting fluid container 316 and are compatible therewith so that the second tubular connector piece 174 of the tubular adapter 146 upon rotating with the interior threads 320 of the neck 318 of the fluid container 316 can be securely removably threadably coupled to each other to provide for a secure portable shower 10, as shown in FIG. 20.

In another embodiment of the present invention, as shown in FIG. 21A-21D and FIG. 22, the tubular adapter 146 is configured with a flange 186 creating a flange adapter 180. In this exemplary embodiment the first tubular connector portion 182 is coaxial with the second tubular portion 184. The flange tubular adapter 180 has been found desirable for use with fluid containers having a neck opening having an internal surface with internal threads thereon. Thus, the flange tubular adapter 180 relates to a transition adapter for use with a preexisting fluid container, having interior threaded neck and the funnel adapter of the portable shower apparatus. In this exemplary embodiment, the fluid container can be a Klean Kanteen®.

The flange tubular adapter 180 comprises a single body having a first end 192 and a second end 194 including a central circumferential annular flange portion 186, and two tubular connector portions 182 extending bi-perpendicularly from the center of the flange 186, a first tubular portion 182 and a second tubular connector portion 184, the first tubular connector portion 182 includes a first opening 196 and the second tubular portion 184 includes a second opening 198. The outer diameter [$OD^{11}$] 200 of the first tubular opening 196 is less than the outer diameter [$OD^{12}$] 204 of the second tubular opening 198. Further, the length of the first tubular portion 182 is less than the length of the second tubular portion 184 of the flange tubular adapter 180.

The flange 184 includes a tubular interior opening (not shown) coaxial with the first opening 196 of the first tubular connector piece 182 and coaxial with the second opening 198 of the second tubular connector portion 184. With this configuration fluid is able to flow freely through the flange tubular adapter 180.

Extending perpendicular to the flange 184, the first tubular connector piece 208 includes a first tubular connector piece 208 formed having an exterior wall surface 188 having the first tubular opening 196 coaxial with the second tubular opening 198 and the flange interior opening therebetween. The first tubular connector piece 208 includes an exterior wall surface 188 and interior wall surface 190 housing an interior tubular hollow space (not shown) for passage of uninterupted flow of fluid. The first tubular connector piece 208 has exterior has threads 212 configured to interfit and threadably couple with the interior threads 106 of the tubular connector piece 90 of the funnel adapter 72 of the portable shower 10. As shown in FIG. 22 the exemplary embodiment of the invention, the exterior threads 212 of the first tubular connector piece 208 of the flange tubular adapter are configured to interfit with the interior threads 106 of the tubular connector piece 90 of the funnel adapter 72 of the portable shower 10.

The second tubular portion 184 of the flange tubular adapter 180 includes the second tubular connection piece 210 formed having the second opening 198 having an outer diameter [$OD^{12}$] 204 greater than the [$OD^{11}$] 200 of the first opening 196 of the first tubular connector piece 208. The second tubular connection piece 210 houses an interior tubular hollow space (not shown) which provides a passage of uninterrupted flow of fluid throughin the flange tubular adapter 180. The second tubular connector piece 210 includes exterior threads 214 configured to rotatably interfit and threadably removably couple with the interior threads of the neck of a preexisting fluid container, for example, a Klean Kanteen®. In a preferred embodiment, the fluid container is a conventional canteen. The dimensions of the second tubular connector piece 210 is configured for threadably engaging an exterior threaded neck portion of the preexisting fluid container, so that no re-tooling of the manufacturing of the fluid container is required and to provide for a secure portable shower 10.

Figure 23C:
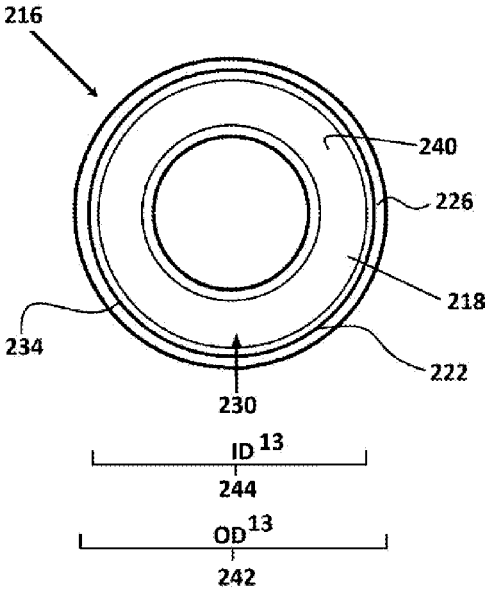
FIG. 23C is a cross sectional view of the hybrid funnel adapter.
Figure 23D:
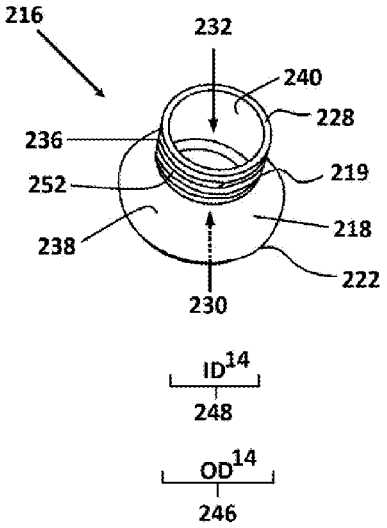
FIG. 23D is a top perspective view of the hybrid funnel adapter.
Figure 24:
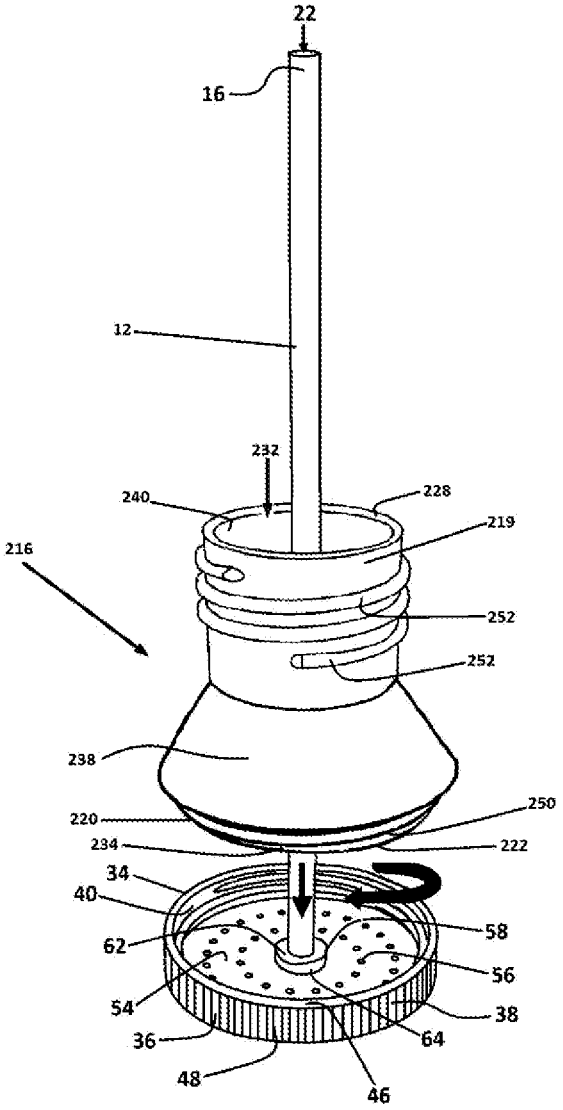
FIG. 24 is a perspective view of the portable shower and the hybrid adapter showing the air evacuator tube inserted throughin the openings of the hybrid funnel adapter.

Still in another embodiment of the invention, a hybrid tunnel adapter 216, as shown in FIGS. 23A-23D and FIG. 24 is provided. The hybrid funnel adapter 216 is a transitional adapter that includes a conical portion 218; a tubular portion 219, and a cylindrical portion 220. The hybrid funnel adapter has a first end 222 and a second end 224 and two opposing openings 230 and 232, a first opening 230 and a second opening 232 wherein the first opening 230 has a larger outer diameter [$OD^{13}$] 242 than the outer diameter [$OD^{14}$] 246 of the second opening 232 defined by the tubular rim 228. In FIG. 23C the rim 226 of the conical portion is slightly wider than the outer diameter [$OD^{13}$] 242 of the cylindrical portion 220 wherein the first opening 230 of the hybrid funnel adapter 216 has an [$ID^{13}$] 244 and the second opening 232 has an [Ile] 248.

Further the hybrid funnel adapter 216 has an exterior surface 238 and an interior surface 240 and includes a cylindrical connector piece 234 including exterior threads 250 threadably compatible to the interior threads 52 of the shower head 34 of the portable shower 10. Furthermore, the hybrid funnel adapter includes a tubular connector piece 236 having exterior threads 252 threadably compatible with a preexisting fluid container having an interior threaded neck, for example, a Kleen Kanteen® bottle.

Figure 25A:
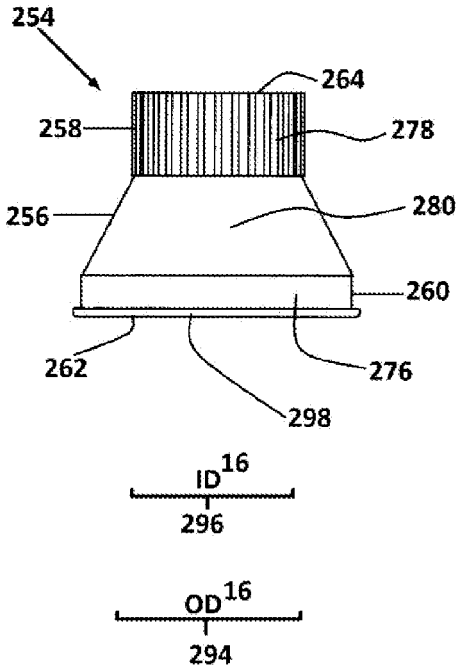
FIG. 25A is side planar view of a snap funnel adapter according to an embodiment of the invention.
Figure 25B:
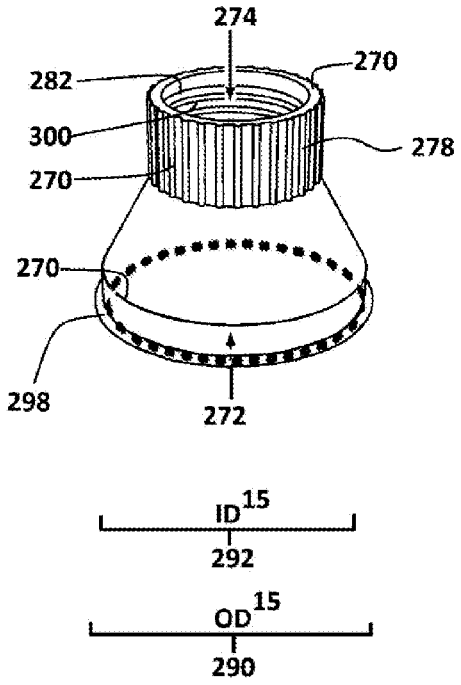
FIG. 25B is a perspective view of the snap funnel adapter.

Still, in another embodiment, as shown in FIGS. 25A and 25B, the portable shower 10 can include a snap funnel adapter 254 to be use with a lip shower head 326 having a corresponding lip portion 328. The snap funnel adapter includes a conical portion 256, a tubular portion 258, and a cylindrical portion 260. The snap funnel includes an exterior surface 280 and interior surface 282; a first end 262 and a second end 264 and includes two opposing openings 272 and 274, a first opening 272 and a second opening 274. The first opening 272 bound by the cylindrical portion 260 includes a greater outer diameter [$OD^{15}$] 290 than the outer diameter [$OD^{16}$] 294 of the second opening 274 bound by tubular portion 258 and similarly the inner diameter [$ID^{15}$] 292 of the first opening 272 is greater than the inner diameter [$ID^{16}$] 296 of the second opening 274.

Further, the cylindrical portion 260 includes a cylindrical connector piece 276 having an exterior lip 298 circumventing the cylindrical connector piece 276 proximal to the first end 262 of the snap funnel adapter 254. The tubular portion 258 includes a tubular connector piece 278 shown having a ribbed exterior surface. The tubular connector piece 278 in another embodiment can be smooth. More particularly, the tubular connector piece 278 of the snap funnel adapter 254 includes interior threads 300 compatible to be threadably removably coupled to the tubular connector portion 118 of the wide mouth adapter 112 as shown in FIGS. 11A-11D embodied by this invention. In addition, the interior threads 300 of the tubular connector piece 278 of the snap funnel adapter 254 are configured to be compatible with a preexisting fluid container having a neck opening having exterior threads.

Figure 26A:
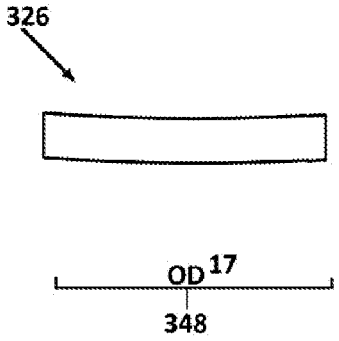
FIG. 26A is a side planar view of a snap shower head according to an embodiment of the invention.
Figure 26B:
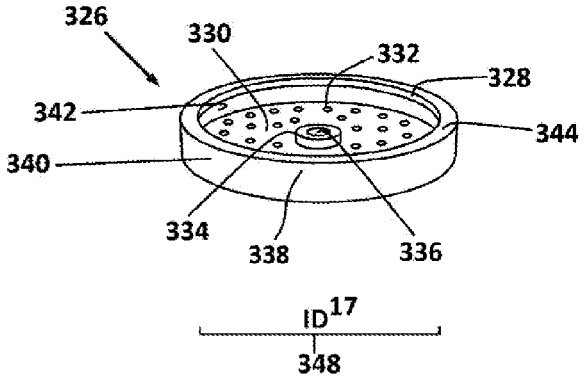
FIG. 26B is a top perspective view of the snap shower head.

The snap funnel adapter 254 is configured to be compatible with the shower head with lip 326 in an exemplary embodiment of the invention. The shower head with lip 326, as shown in FIGS. 26A and 26B the shower head with lip 326 includes a shower plate 330 including a plurality of fluid distribution holes 332 and a centrally disposed cylindrical connector nipple 334 having a bore 336 therethrough. The shower head with lip 326 is circumferentially bound by a connector ring 338 having an exterior wall 340 and an interior wall 342. The exterior wall 340 is shown with a smooth exterior surface 322. The connector ring 338 terminates at a rim 344 wherewith the lip 328 is formed. The lip shower head connector ring 338 includes an outer diameter [$OD^{17}$] and an [$ID^{17}$] configured to correspond to the [$OD^{15}$] and the [$ID^{15}$] of the first opening 272 snap funnel adapter 254.

In an exemplary embodiment of the invention, assembly of the portable shower 10, as shown in FIGS. 1-10 comprises the steps including providing the air evacuator tube 12; the shower head 34; and the funnel adapter 72, preexisting fluid container 302 having exterior threads 306 on the neck 304 portion. As way of example, but by no means limiting, a 1 liter water bottle 302 shall be used in the following description to describe the fluid container. The shower head 34, funnel adapter 72, and preexisting water bottle 302 are fluidly connected to each other. Fluid or water 308 is provided by either step, such as, small volume of water is poured out of a new or preexisting water bottle filled to full capacity with water, or an empty water bottle 302 is filled with water to approximately less than full capacity.

First step, the air evacuator tube 12 is removably inserted to the shower head 34 by inserting the first end 14 of the air evacuator tube 12 throughin the connector nipple bore 60, as shown in FIGS. 6A-6B. Further, as shown in FIG. 1 the shower head 34 is positioned with the ring connector collar 36 in an up position so that the opening is facing up and the ring connector collar 36 internal threads 52 are revealed advancing toward the external threads 104 of the cylindrical connector piece 88 of the funnel adapter 72. Again, as shown in FIGS. 6A-6B the air evacuator tube 12 is inserted snugly through the connector nipple bore 60 opening with proper alignment so that the first opening 20 of the air evacuator tube is exposed to the environmental air. More particularly, so disposed the air evacuator tube 12 provides passage of environmental air which can be delivered throughin the inlet opening 20 and routed out through the outlet opening 22 of the air evacuator tube 12.

The second step includes inserting the second end 22 of the air evacuator tube 12 throughin the first opening 84 of the funnel adapter 72 and out through the second opening 86 of the funnel adapter 72. The funnel adapter 72 is thereby held about the air evacuator tube 12 with the 104 exterior threaded 104 cylindrical connector piece 88 advanced towards the interior threaded 52 ring connector collar 36 of the shower head 34. Consequently, the interior threaded 106 tubular connector piece 90 of the funnel adapter 72 is pivotly advanced toward the exterior threaded 306 of the neck 304 of the water bottle 302, as illustrated in FIGS. 1 and 9.

Subsequently, the cylindrical connector piece 88 of the funnel adapter 72 is interfitted to the ring connector collar 36 of the shower head 34. The internal threads 52 of the ring connector collar 36 are threadably screwed onto the external threads 104 of the funnel cylindrical connector piece 88 so that the shower head 34 and funnel adapter 72 are threadably removably coupled to each other and secured by turning and tightening the shower head 34 and the funnel adapter 72 to each other. At this point, the shower head 34 and the funnel adapter 72 are fluidly connected by a secure connection having the air evacuator tube 12 therein. Illustratively, as shown in FIGS. 9 and 10 in this embodiment of the portable shower 10, the funnel adapter 72 and shower head 34 exist as one structure.

The third step includes inserting the second end 16 of the air evacuator tube 12 into the 1 liter bottle 302 filled with water 308 with shower head 34 and funnel adapter 72 coupled securely together. The 1 liter water bottle 302 includes a neck 304 having external threads 306 compatible with the internal threads 106 of the tubular connector piece 90 of the funnel adapter 72, and water bottle having a neck opening diameter approximately slightly less than the inner diameter [ID$^6$] of the tubular connector piece 90. The air evacuator tube 12 is inserted into the 1 liter bottle 302 reaching proximate to the bottom of the vessel, containing a full bottle of water as water bottle is standing upright. Subsequently the portable shower 10 is advanced towards the 1 liter bottle and interfitted therewith. The tubular connector piece 90 of the funnel adapter 72 is threadably screwed onto the external threads 306 of the 1 liter bottle 302 and further twisted and tightened to securely removably couple and connect the portable shower 10 to the neck 34 of the 1 liter water bottle 302. FIG. 10 shows an assembled view of the portable shower 10, at this point, the portable shower 10 and the 1 liter bottle 302 are fluidly connected by a secure connection having the air evacuator tube 12 therein.

Providing an assembled portable shower 10 as described above, so that the portable shower 10 is removably threadably connected to a fluid container, for example a conventional 1 liter bottle 302. The portable shower 10 is inverted and now ready to be utilized to wash a user. The user holds the portable shower 10 securely coupled to the 1 liter water bottle over his or her head allowing the water to stream through the distribution holes 56 of the shower face plate 54 of the portable shower 10. In the depicted embodiment, as shown in FIG. 10 the air evacuator tube 12 outlet opening 22 is open into the vessel of the water bottle 302. Environmental air entering the first opening 20 of the air evacuator tube 12 is delivered through to rear of the vessel of the water bottle 302.

As depicted in FIG. 10, aeration is carried out when air is then dispensed from the outlet 22 of the air evacuator tube 12, the air will flow into the intake opening 20 so that the air is supplied to the interior of the bottle vessel. At this time, negative pressure will arise in the vicinity of the outlet 22 of the air evacuator tube 12 due to the flow speed of air flowing through the air evacuator tube 12 hollow passage. This negative pressure facilitates outflow of water 308 as illustrated by the droplets of water from the water bottle 302 through the portable shower 10 via the funnel adapter 72 continuing through the shower head 34 and showered through the fluid distribution holes 56 of the shower faceplate 54. Thus, water 308 can be expelled through the fluid distribution holes 56 smoothly and not dependent on squeezing the bottle and applying pressure by the user.

In operation, the portable shower 10 is easily coupled to a preexisting fluid container, for example a filled water bottle that is particularly suited for handling the assembled portable shower by hand. The threads of the funnel adapter 72, the wide container adapter 112, the tubular adapter 146, the flange tubular adapter 180, the hybrid funnel adapter 216, and the snap funnel adapter 254, and any of adapters configured for use that are compatible to conventional fluid container threads and thereby allow the adaptors to function in a variety of situations using a variety of standard preexisting fluid containers The portable shower 10 may easily be utilized with fluid containers of a variety of sizes, for example, any one of a water bottle, 1 liter bottle, Nalgene® Bottle, Klean Kanteen®, energy drink bottle, gallon milk bottle, gallon ice tea bottle, canteen. The portable shower 10 may advantageously be utilized as an outdoor washing apparatus in open spaces such as, for example, pools, beaches, gardens, campgrounds, disaster areas, etc. In operation, fluid, preferably water, can be heated by the solar radiation.

In operation, water in the reservoir of the bottle can be heated by solar radiation when the filled water bottle is exposed to the sun for an extended period of time.

In accordance with the various embodiments of the present invention, this invention relates to a variety of unique container adapters is disclosed that allows commercially available fluid containers to be adapted for use with the portable shower apparatus. In a preferred embodiment of the present invention, the fluid container adapter can be used to assist in the showering of a human.

It is also understood that while the embodiments herein include a set of internal thread segments for soda and bottled water plastic bottles, it will be recognized by those skilled in the art that the dimensions can easily be adjusted to fit the varying bottle necks from any other bottle using containers having external threads upon which the container adapters of the present invention may be installed. That is to say, the set of internal thread pieces of any of the embodiments disclosed herein can be readily adjusted by reconfiguration and relocation of the thread pieces to match any external threaded portion of any container.

Similarly, it will be recognized by those skilled in the art that the dimensions can easily be adjusted to fit the varying bottle necks from any other bottle using containers having internal threads upon which the container adapters of the present invention may be installed. That is to say, the set of external thread connector pieces of any of the embodiments disclosed herein can be readily adjusted by reconfiguration and relocation of the thread pieces to match any internal threaded portion of any container.

It will be appreciated by one of ordinary skill in the art that liquid containers may have yet other different types of external threads and different water bottle neck dimensions. It is also understood that shower head ring collar connectors may also vary in diameter having differing types of internal threads. As such, it is understood that other embodiments of the present can be easily adapted to conform to the different threads used on the fluid container or the adapters, or the shower head ring connector and still remain within the intended scope of the present invention.

Although the portable shower is described herein primarily in conjunction with use as a shower to wash a human, other uses are contemplated. For example, the portable shower can be used with use to wash an animal; to wash a topical wound.

With respect to the above description then, it is to be realized that the optimum dimensional relationships for the elements of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be restored to, falling within the scope and spirit of the disclosure.

I claim:

1. A portable shower apparatus, for engagement to a threaded neck of a fluid container, the portable shower apparatus comprising:

an air evacuator tube having a length having a first end and an opposing second end;

said first end includes a first opening and said second end includes a second opposing opening;

said first opening having an outer diameter and inner diameter substantially equal to an outer diameter and an inner diameter of said second opening;

a shower head having a housing body formed by a ring connector collar circumventing a shower faceplate;

said ring connector collar having an outer diameter and an inner diameter;

said ring connector collar having an exterior wall surface and interior wall surface having a height and thereon a said interior wall surface includes interior threads;

said shower face plate having a centrally disposed nipple connector having a bore dimensioned for inserting said first end of said air evacuator tube;

said shower face plate having a plurality of fluid distribution holes for flow of a fluid therethrough;

a funnel adapter formed by a hollow single body having a conical portion, a cylindrical portion, and a tubular portion, the funnel adapter having a first end and an opposing second end;

said first end having a first opening and said second end having an opposing second opening wherein said first opening having an outer diameter greater than an outer diameter of said second opening;

a cylindrical connector piece extending from the conical portion around said first opening;

an exterior surface of said cylindrical connector piece having exterior surface threads whereby said cylindrical connector piece is adapted for threadably engaging said interior threaded ring connector collar;

a tubular connector piece extending from said conical portion around said second opening; and an interior surface of said tubular connector piece having interior surface threads whereby said tubular connector piece is adapted for threadably engaging the threaded neck of the fluid container.

2. The portable shower apparatus of claim 1, wherein the air evacuator tube is flexible.

3. The portable shower apparatus of claim 1, wherein the air evacuator tube is rigid.

4. The portable shower apparatus of claim 1, wherein the neck of the fluid container comprises exterior surface threads.

5. A portable shower apparatus, for engagement to a threaded neck of a fluid container, the portable shower apparatus comprising:

an air evacuator tube having a length having a first end and an opposing second end;

said first end includes a first opening and said second end includes a second opposing opening;

said first opening having an outer diameter and inner diameter substantially equal to an outer diameter and an inner diameter of said second opening;

a shower head having a housing body formed by a ring connector collar circumventing a shower faceplate;

said ring connector collar having an outer diameter and an inner diameter;

said ring connector collar having an exterior wall surface and interior wall surface having a height and thereon a said interior wall surface includes interior threads;

said shower face plate having a centrally disposed nipple connector having a bore dimensioned for inserting said first end of said air evacuator tube;

said shower face plate having a plurality of fluid distribution holes for flow of a fluid therethrough;

a funnel adapter formed by a hollow single body having a conical portion, a cylindrical portion, and a tubular portion, the funnel adapter having a first end and an opposing second end;

said first end having a first opening and said second end having an opposing second opening wherein said first opening having an outer diameter greater than an outer diameter of said second opening;

a cylindrical connector piece extending from the conical portion around said first opening;

an exterior surface of said cylindrical connector piece having exterior surface threads whereby said cylindrical connector piece is adapted for threadably engaging said interior threaded ring connector collar;

a tubular connector piece extending from said conical portion around said second opening; and an exterior surface of said tubular connector piece having interior surface threads whereby said tubular connector piece is adapted for threadably engaging the threaded neck of the fluid container.

6. The portable shower apparatus of claim 5, wherein the air evacuator tube is flexible.

7. The portable shower apparatus of claim 5, wherein the air evacuator tube is rigid.

8. The portable shower apparatus of claim 5, wherein the neck of the fluid container comprises interior surface threads.

9. A portable shower apparatus, for engagement to a threaded neck of a fluid container, the portable shower apparatus comprising:

an air evacuator tube having a length having a first end and an opposing second end;

said first end includes a first opening and said second end includes a second opposing opening;

said first opening having an outer diameter and inner diameter substantially equal to an outer diameter and an inner diameter of said second opening;

a shower head having a housing body formed by a ring connector collar circumventing a shower faceplate;

said ring connector collar having an outer diameter and an inner diameter;

said ring connector collar having an exterior wall surface and interior wall surface having a height and thereon a said interior wall surface includes interior threads;

said shower face plate having a centrally disposed nipple connector having a bore dimensioned for inserting said first end of said air evacuator tube;

said shower face plate having a plurality of fluid distribution holes for flow of a fluid therethrough;

a funnel adapter formed by a hollow single body having a conical portion, a cylindrical portion, and a tubular portion, the funnel adapter having a first end and an opposing second end;

said first end having a first opening and said second end having an opposing second opening wherein said first opening having an outer diameter greater than an outer diameter of said second opening;

a cylindrical connector piece extending from the conical portion around said first opening;

an exterior surface of said cylindrical connector piece having exterior surface threads whereby said cylindrical connector piece is adapted for threadably engaging said interior threaded ring connector collar;

a tubular connector piece extending from said conical portion around said second opening;

an interior surface of said tubular connector piece having interior surface threads;

a wide mouth adapter having a wide mouth cylindrical connector piece and a wide mouth tubular connector piece;

a first opening formed by said wide mouth cylindrical connector piece and a second opening formed by wide mouth tubular connector piece;

an exterior surface of said wide mouth tubular connector piece having exterior surface threads whereby said wide mouth tubular connector piece is adapted for threadably engaging the interior threaded surface of said funnel adapter tubular connector piece; and an interior surface of said wide mouth connector piece having interior surface threads is adapted for threadably engaging the threaded neck of the fluid container.

10. A portable shower apparatus, for engagement to a threaded neck of a fluid container, the portable shower apparatus comprising:

an air evacuator tube having a length having a first end and an opposing second end;

said first end includes a first opening and said second end includes a second opposing opening;

said first opening having an outer diameter and inner diameter substantially equal to an outer diameter and an inner diameter of said second opening;

a shower head having a housing body formed by a ring connector collar circumventing a shower faceplate;

said ring connector collar having an outer diameter and an inner diameter;

said ring connector collar having an exterior wall surface and interior wall surface having a height and thereon a said interior wall surface includes interior threads;

said shower face plate having a centrally disposed nipple connector having a bore dimensioned for inserting said first end of said air evacuator tube;

said shower face plate having a plurality of fluid distribution holes for flow of a fluid therethrough;

a funnel adapter formed by a hollow single body having a conical portion, a cylindrical portion, and a tubular portion, the funnel adapter having a first end and an opposing second end;

said first end having a first opening and said second end having an opposing second opening wherein said first opening having an outer diameter greater than an outer diameter of said second opening;

a cylindrical connector piece extending from the conical portion around said first opening;

an exterior surface of said cylindrical connector piece having exterior surface threads whereby said cylindrical connector piece is adapted for threadably engaging said interior threaded ring connector collar;

a tubular connector piece extending from said conical portion around said second opening; and an interior surface of said tubular connector piece having interior surface threads;

a tubular adapter having two co-axial tubular adapter connector pieces, a first tubular adapter connector piece and a second tubular adapter connector piece;

a first opening formed from the first tubular connector piece and a second opening formed from said tubular connector piece;

an exterior surface of said first tubular adapter tubular connector piece having exterior threads adapted for threadably engaging said interior threaded funnel adapter tubular connector piece; and an exterior surface of said second tubular adapter tubular connector piece is adapted for threadably engaging the threaded neck of the fluid container.

11. The portable shower apparatus of claim 10, wherein the tubular adapter further comprises a flange.

* * * * *